United States Patent [19]

Okumura

[11] Patent Number: 4,840,027

[45] Date of Patent: Jun. 20, 1989

[54] DOUBLE AIR-FUEL RATIO SENSOR SYSTEM HAVING IMPROVED EXHAUST EMISSION CHARACTERISTICS

[75] Inventor: Atsuo Okumura, Toyota, Japan

[73] Assignee: Toyota Jidosha Kabushiki Kaisha, Aichi, Japan

[21] Appl. No.: 105,696

[22] Filed: Oct. 8, 1987

[30] Foreign Application Priority Data

Oct. 13, 1986 [JP] Japan ..... 61-241486
Jul. 7, 1987 [JP] Japan ..... 62-167819

[51] Int. Cl.[4] ..... F01N 3/20; F02D 41/14

[52] U.S. Cl. ..... 60/274; 60/276; 60/285; 123/489

[58] Field of Search ..... 123/440, 489, 589; 60/274, 276, 285; 364/431.05

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,099,491 | 7/1978 | Reddy | 123/489 |
| 4,130,095 | 12/1978 | Bowler et al. | 123/440 |
| 4,178,884 | 12/1979 | Norimatsu et al. | 123/489 |
| 4,235,204 | 11/1980 | Rice | 123/440 |
| 4,401,086 | 8/1983 | Miyagi | 123/489 |
| 4,475,517 | 10/1984 | Kobayashi et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |

FOREIGN PATENT DOCUMENTS

| | | |
|---|---|---|
| 52-102934 | 8/1977 | Japan . |
| 53-103796 | 9/1978 | Japan . |
| 55-37562 | 3/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-48755 | 3/1983 | Japan . |
| 58-48756 | 3/1983 | Japan . |
| 58-53661 | 3/1983 | Japan . |
| 58-72646 | 4/1983 | Japan . |
| 58-72647 | 4/1983 | Japan . |
| 58-135343 | 8/1983 | Japan . |
| 58-150038 | 9/1983 | Japan . |
| 58-150039 | 9/1983 | Japan . |
| 58-152147 | 9/1983 | Japan . |
| 59-32644 | 2/1984 | Japan . |
| 59-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |

*Primary Examiner*—Andrew M. Dolinar
*Attorney, Agent, or Firm*—Oliff & Berridge

[57] ABSTRACT

In a double air-fuel sensor system including two air-fuel ratio sensors upstream and downstream of a catalyst converter provided in an exhaust gas passage, an air-fuel ratio correction amount is calculated in accordance with the outputs of the upstream-side and downstream-side air-fuel ratio sensors, thereby obtaining an actual air-fuel ratio. When the output of the downstream-side air-fuel ratio sensor is switched from the rich side to the lean side or vice versa, the speed of renewal of the air-fuel ratio correction amount by the output of the downstream-side air-fuel ratio sensor is remarkably increased, and thereafter, this renewal speed is gradually decreased.

22 Claims, 24 Drawing Sheets

| Fig.4 A | Fig.4 B | Fig.4 C |
|---|---|---|

LEAN
RICH
A/F1
TDR
CDLY 0
t1
t2
t3
t4
t5
t6
t7
t8
TDL
A/F1'
(F1)

TDR
LEAN
RICH
(-TDL)
TDR

RSL
KIR
FAF1
RSR
KIL

| Fig. 6A | Fig. 6B | Fig. 6C |
|---|---|---|

V
1
$V_{R1}$
0
$V_1$
LEAN
RICH
(-TDL)
TDR
KIR
RSL
FAF1
RSR
KIL
1
$V_{R2}$
0
$V_2$
LEAN
"1"
"0"
RICH
F2
A
KI2
0
KI2
FAF2
RS2
KI2
KI2
RS2
LEAN
PRIOR ART
λ=1
A/F
RICH

1
VR2
0
V2

"1"
"0"
LEAN
RICH
F2

A1
A2
KIL
k2
k1
KIR
KIL
k2
KIR
k1
0

FAF2
RS2
KIR
KIL
RS2

LEAN
λ=1
RICH
PRIOR ART
A/F'(SYMMERICAL)
A/F (ASYMMERICAL)

| Fig.11A | Fig.11B | Fig.11C |
|---|---|---|

Fig. 13A
Fig. 13B
Fig. 13C
Fig. 13D
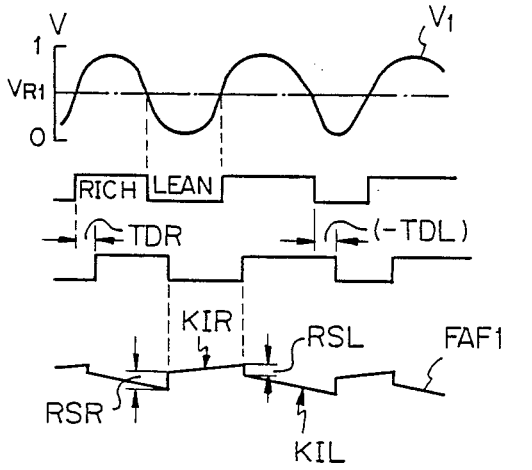
Fig. 13E
Fig. 13F
Fig. 13G
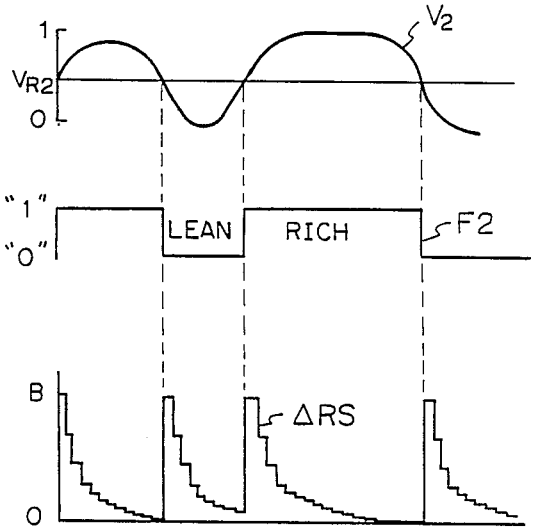

V
1
V2
VR2
0

"1"
"0"
LEAN
RICH
F2

ΔRS
B1
B2
0
k1
k2
k2
k1

RSR

RSL

LEAN
λ =1
RICH
PRIOR ART
A/F (ASYMMETRICAL)
A/F (SYMMETRICAL)

DOUBLE AIR-FUEL RATIO SENSOR SYSTEM HAVING IMPROVED EXHAUST EMISSION CHARACTERISTICS

BACKGROUND OF THE INVENTION (1) Field of the Invention

The present invention relates to a method and apparatus for feedback control of an air-fuel ratio in an internal combustion engine having two air-fuel ratio sensors upstream and downstream of a catalyst converter disposed within an exhaust gas passage.

(2) Description of the Related Art

Generally, in a feedback control of the air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio.

According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_X$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

To compensate for the fluctuation of the controlled air-fuel ratio, double $O_2$ sensor systems have been suggested (see: U.S. Pat. Nos. 3,939,654, 4,027,477, 4,130,095, 4,235,204). In a double $O_2$ sensor system, another $O_2$ sensor is provided downstream of the catalyst converter, and thus an air-fuel ratio control operation is carried out by the downstream-side $O_2$ sensor in addition to an air-fuel ratio control operation carried out by the upstream-side $O_2$ sensor. In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream side $O_2$ sensor.

(3) On the downstream side of the catalyst converter, the exhaust gas is mixed so that the concentration of oxygen in the exhaust gas is approximately in an equilibrium state.

Therefore, according to the double $O_2$ sensor system, the fluctuation of the output of the upstream-side $O_2$ sensor is compensated for by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, since the downstream-side $O_2$ sensor is located on the downstream side of the catalyst converter, this $O_2$ sensor generates an air-fuel ratio signal indicating a rich state or a lean state, with a delay. That is, the output of the downstream-side 0 sensor is delayed by the $O_2$ storage effect of the catalyst converter (three-way catalysts). Therefore, when the output of the downstream-side $O_2$ sensor is switched from the lean side to the rich side, the air-fuel ratio on the upstream side of the catalysts converter is already greatly deviated from the stoichiometric air-fuel ratio to the rich side, increasing the HC and CO emissions and thus increasing the fuel consumption. Conversely, when the output of the downstream-side $O_2$ sensor is switched from the rich side to the lean side, the air-fuel ratio on the upstream side of the catalyst converter is already greatly deviated from the stoichiometric air-fuel ratio to the lean side, increasing the $NO_X$ emission and thus reducing the drivability characteristics.

The $O_2$ storage effect of the three-way catalyst converter will be explained with reference to FIG. 2. In FIG. 2, the ordinate n represents the catalytic cleaning rate, and the abscissa A/F represents the air-fuel ratio of the exhaust gas. That is, as illustrated by dotted lines, when the air-fuel ratio is on the rich side with respect to the stoichiometric air-fuel ratio ($\lambda=1$), the cleaning rate $\eta$ of the $NO_X$ emission is increased, but when the air-fuel ratio is on the lean side with respect to the stoichiometric air-fuel ratio, the cleaning rate of the HC and CO emissions is increased (although HC is not shown, it has the same tendency as CO). As a result, if $\eta_0$ is an optimum cleaning rate, the controlled air-fuel ratio window is within a very narrow width $W_1$. However, the three-way catalysts have an $O_2$ storage effect whereby, when the air-fuel ratio is lean these catalysts absorb oxygen, and when the air-fuel ratio is rich they absorb and react HC and CO with the already absorbed oxygen. Therefore, since an air-fuel ratio feedback control makes positive use of this $O_2$ storage effect to obtain an optimum frequency and amplitude of the controlled air-fuel ratio, the cleaning rate n is improved and thus the controlled air-fuel ratio window ($W=W_2$) is substantially increased. Especially, if the window is narrow, the NOX emission is remarkably increased when the controlled air-fuel ratio is deviated from the rich state to the lean side.

SUMMARY OF THE INVENTION

It is an object of the present invention to provide a double air-fuel ratio sensor system having an improved exhaust emission, drivability, and fuel consumption characteristics.

Therefore, according to the present invention, in a double air-fuel sensor system including two air-fuel ratio sensors upstream and downstream of a catalyst converter provided in an exhaust gas passage, an air-fuel ratio correction amount is calculated in accordance with the outputs of the upstream-side and downstream-side air-fuel ratio sensors, thereby obtaining an actual air-fuel ratio. When the output of the downstream-side air-fuel ratio sensor is switched from the rich side to the lean side or vice versa, the speed of changing the air-fuel ratio correction amount by the output of the downstream-side air-fuel ratio sensor is remarkably increased in accordance with a speed skip amount. Thereafter, this changing speed is gradually decreased. As a result, the response speed of the downstream-side air-fuel ratio sensor is substantially increased to promptly return the controlled air-fuel ratio to the stoichiometric air-fuel ratio, thereby improving the emission characteristics, the fuel consumption characteristics, and the drivability characteristics.

BRIEF DESCRIPTION OF THE DRAWINGS

The present invention will be more clearly understood from the description as set forth below with reference to the accompanying drawings, wherein:

FIGS. 13A through 13J are timing diagrams explaining the flowcharts of FIGS. 4, 11, and 12;

DESCRIPTION OF THE PREFERRED EMBODIMENTS

Figure 1:
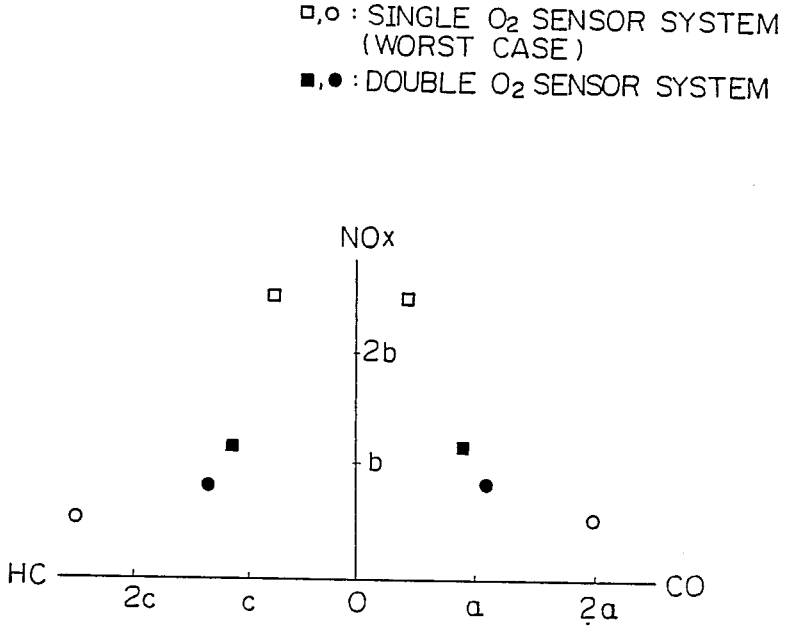
FIG. 1 is a graph showing the emission characteristics of a single $O_2$ sensor system and a double $O_2$ sensor system.
Figure 2:
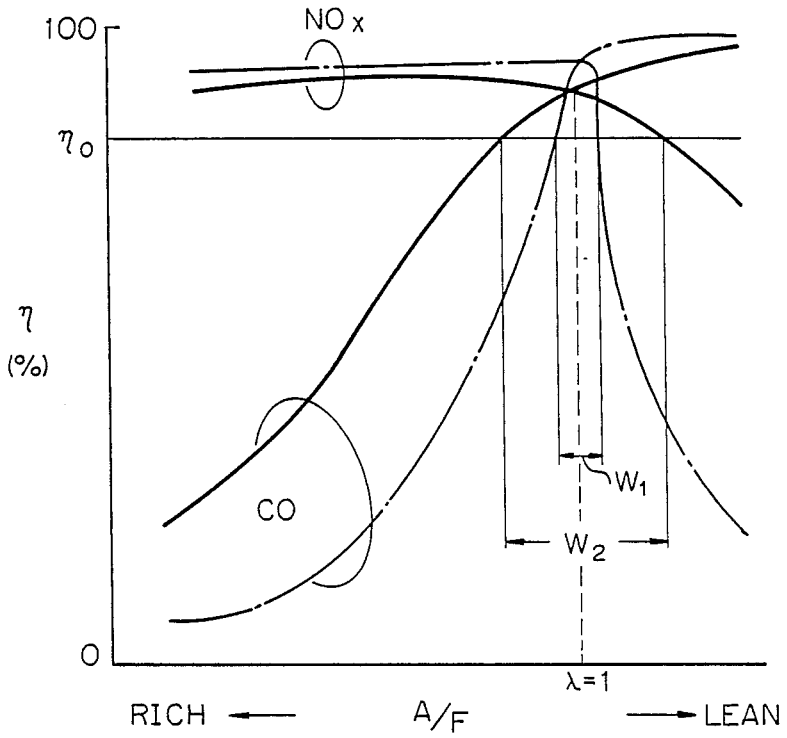
FIG. 2 is a graph showing the $O_2$ storage effect of three-way catalysts.
Figure 3:
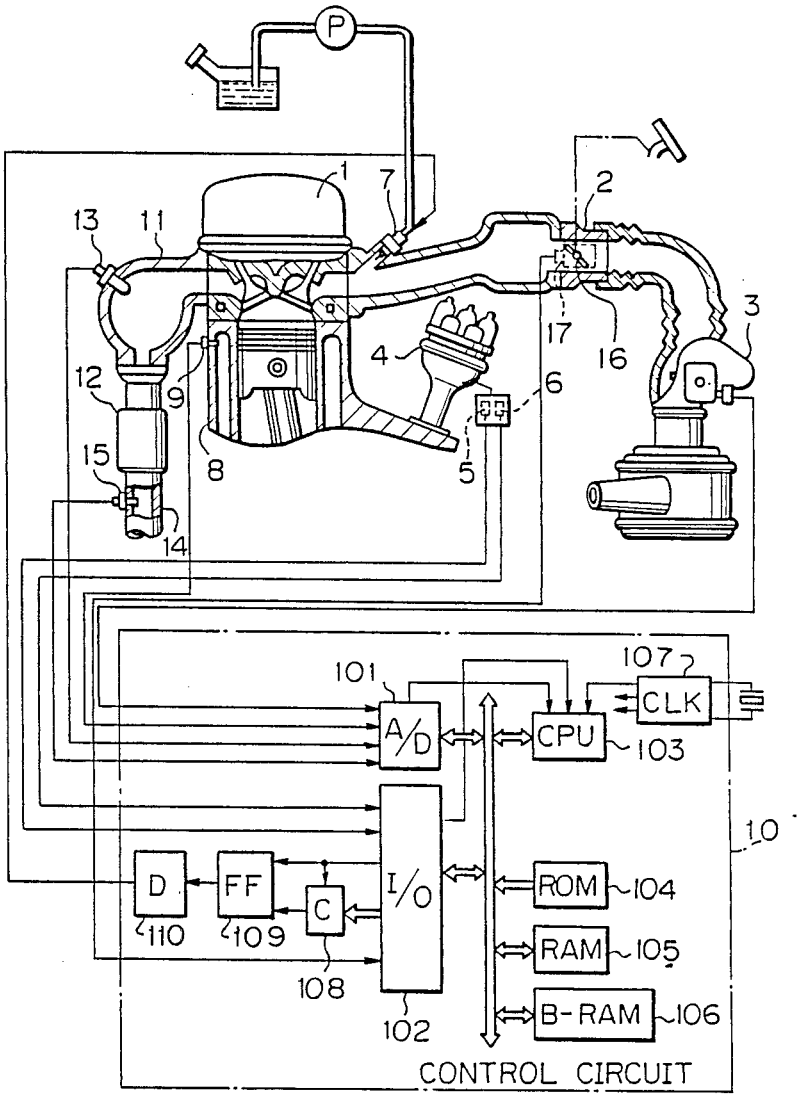
FIG. 3 is a schematic view of an internal combustion engine according to the present invention.

In FIG. 3, which illustrates an internal combustion engine according to the present invention, reference numeral 1 designates a four-cycle spark ignition engine disposed in an automotive vehicle. Provided in an air-intake passage 2 of the engine 1 is a potentiometertype airflow meter 3 for detecting the amount of air drawn into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1.

In this case, the crank-angle sensor 5 generates a pulse signal at every 720° crank angle (CA) while the crank-angle sensor 6 generates a pulse signal at every 30° CA. The pulse signals of the crank angle sensors 5 and 6 are supplied to an input/output (I/O) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, but are not shown in FIG. 3.

Disposed in a cylinder block 8 of the engine 1 is a coolant temperature sensor 9 for detecting the temperature of the coolant. The coolant temperature sensor 9 generates an analog voltage signal in response to the temperature THW of the coolant and transmits that signal to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_X$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit those signals to the A/D converter 101 of the control circuit 10.

Reference 16 designates a throttle valve, and 17 an idle switch for detecting whether or not the throttle valve 16 is completely closed.

The control circuit 10, which may be constructed by a microcomputer, further comprises a central processing unit (CPU) 103, a read-only memory (ROM) 104 for storing a main routine, interrupt routines such as a fuel injection routine, an ignition timing routine, tables (maps), constants, etc., a random access memory 105 (RAM) for storing temporary data, a backup RAM 106, an interface 1O2 of the control circuit 10.

The control circuit 10, which may be constructed by a microcomputer, further comprises a central processing unit (CPU) 103, a read-only memory (ROM) 104 for storing a main routine and interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is not erased even when the ignition switch (not shown) is turned off.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal of the down counter 108, to reset the flip-flop 109, so that the driver circuit 110 stops the activation of the fuel injection valve 7. Thus, the amount of fuel corresponding to the fuel injection amount TAU is injected into the fuel injection valve 7.

Interruptions occur at the CPU 103 when the A/D converter 101 completes an A/D conversion and generates an interrupt signal; when the crank angle sensor 6 generates a pulse signal; and when the clock generator 107 generates a special clock signal.

The intake air amount data Q of the airflow meter 3 and the coolant temperature data THW of the coolant sensor 9 are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30° CA, i.e., at every pulse signal of the crank angle sensor 6, and is then stored in the RAM 105.

The operation of the control circuit 10 of FIG. 3 will be now explained.

Figures 4, 4A:
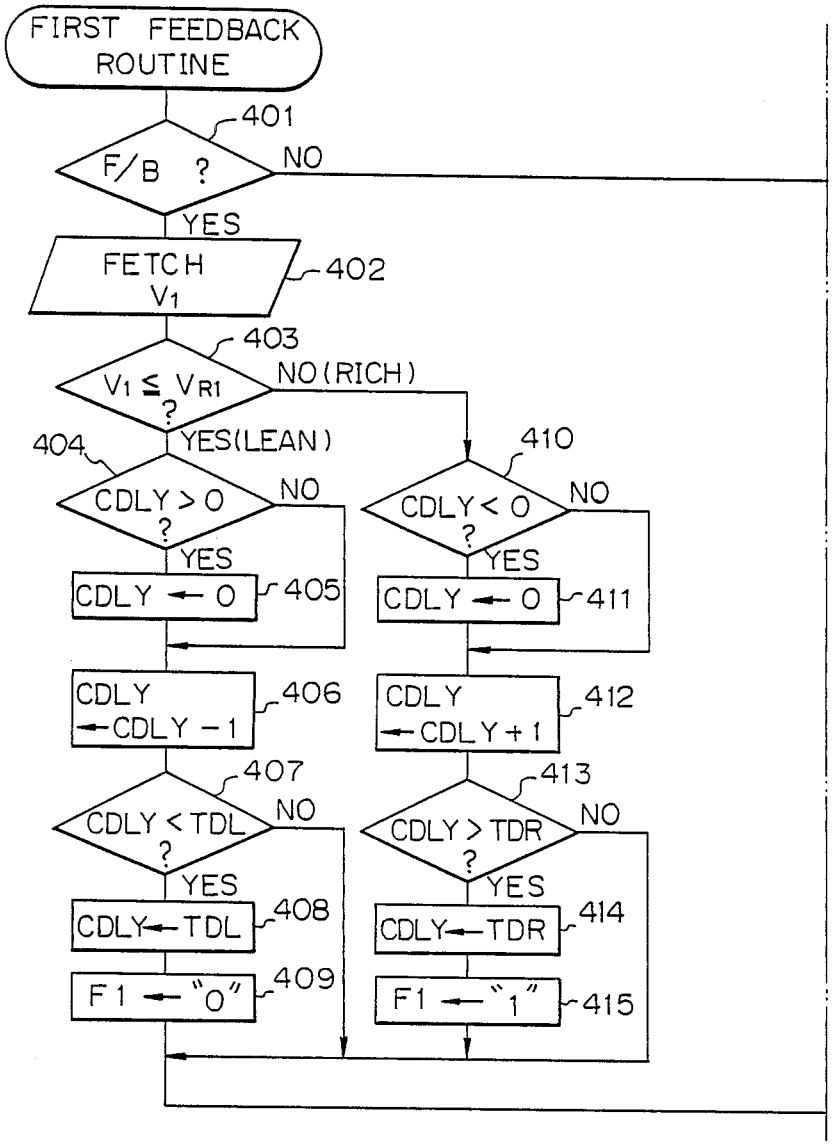
FIGS. 4, 4A-4C, 6, 6A-6C, 7, 9, 11, 11A-11C, 12, and 14 are flow charts showing the operation of the control circuit of FIG. 3.
Figure 4B:
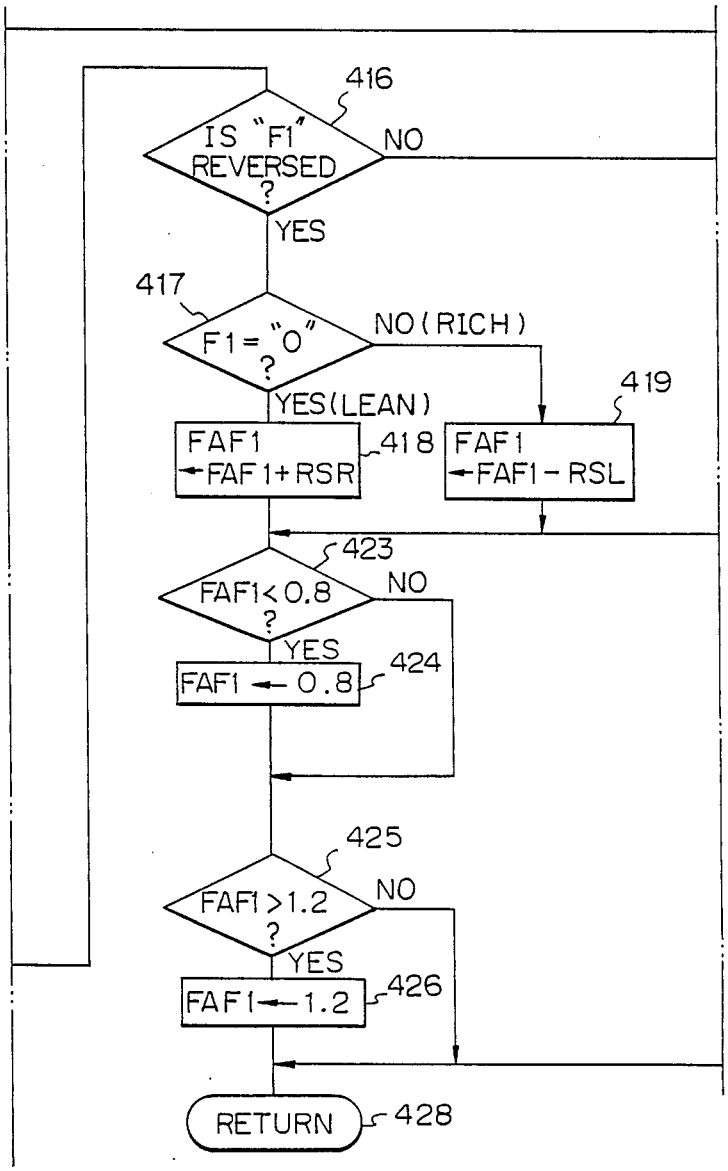
Figure 4C:
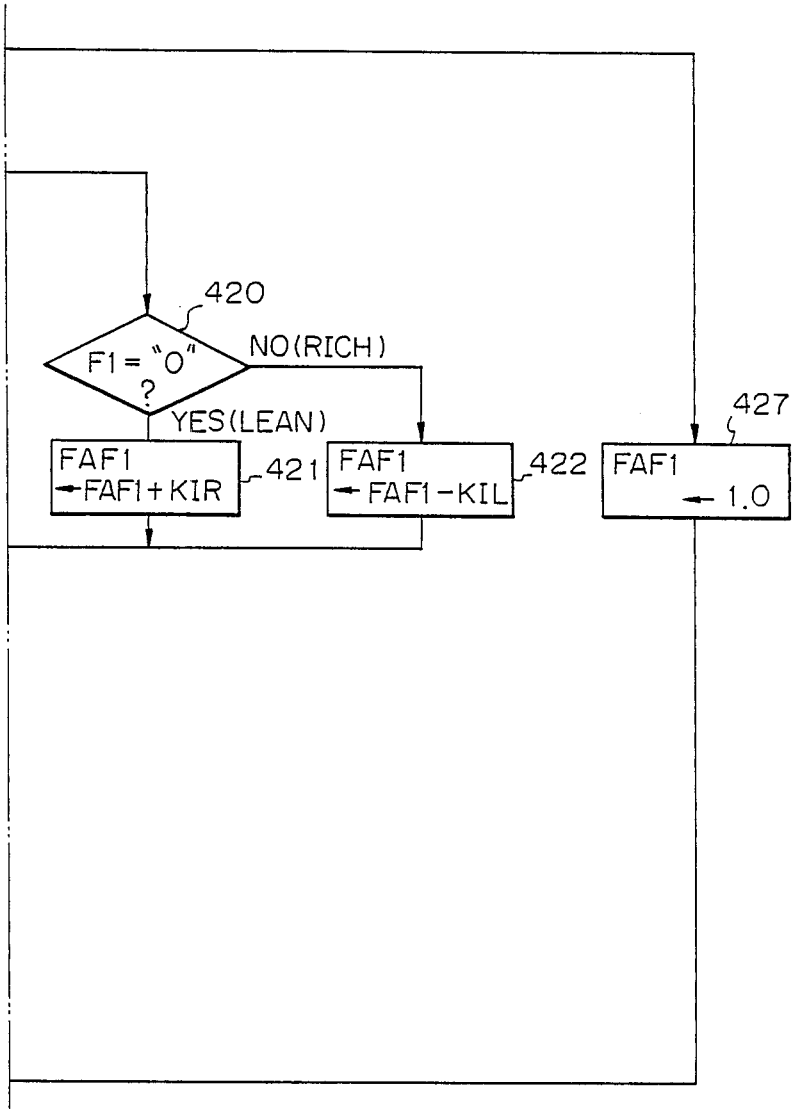

FIG. 4 is a routine for calculating a first air-fuel ratio feedback correction amount FAF1 in accordance with output of the upstream-side $O_2$ sensor 13 executed at every predetermined time period such as 4 ms.

At step 301, it is determined whether or not all of the feedback control (closed-loop control) conditions by the upstream-side $O_2$ sensor 13 are satisfied. The feedback control conditions are as follows:

(i) the engine is not in a starting state;

(ii) the coolant temperature THW is higher than 50° C.;

(iii) the power fuel incremental amount FPOWER is 0; and (iv) the upstream-side $O_2$ sensor 13 is in an activated state.

Note that the determination of activation/nonactivation of the upstream-side $O_2$ sensor 13 is carried out by determining whether or not the coolant temperature THW≧70° C., or by whether or not the output of the upstream-side $O_2$ sensor 13 is once swung, i.e., once changed from the rich side to the lean side, or vice versa. Of course, other feedback control conditions are introduced as occasion demands. However, an explanation of such other feedback control conditions is omitted.

If one of more of the feedback control conditions is not satisfied, the control proceeds to step 427, in which the amount FAF1 is caused to be 1.0 (FAF1=1.0), thereby carrying out an open-loop control operation. Note that, in this case, the amount FAF1 can be a value or a mean value immediately before the open-loop control operation. That is, the amount FAF1 or a mean value FAF1 thereof is stored in the backup RAM 106, and in an open-loop control operation, the value FAF1 or is read out of the backup RAM 106.

Contrary to the above, at step 401, if all of the feedback control conditions are satisfied, the control proceeds the step 402.

At step 402, an A/D conversion is performed upon the output voltage $V_1$ of the upstream-side $O_2$ sensor 13, and the A/D converted value thereof is then fetched from the A/D converter 101. Then at step 403, the voltage $V_1$ is compared with a reference voltage $V_{R1}$ such as 0.45 V, thereby determining whether the current air-fuel ratio detected by the upstream-side $O_2$ sensor 13 is on the rich side or on the lean side with respect to the stoichiometric air-fuel ratio.

If $V_1 \leqq V_{R1}$, which means that the current air-fuel ratio is lean, the control proceeds to step 404, which determines whether or not the value of a delay counter CDLY is positive. If CDLY>0, the control proceeds to step 405, which clears the delay counter CDLY, and then proceeds to step 406. If CDLY≦0, the control proceeds directly to step 406. At step 406, the delay counter CDLY is counted down by 1, and at step 407, it is determined whether or not CDLY<TDL. Note that TDL is a lean delay time period for which a rich state is maintained even after the output of the upstream-side $O_2$ sensor 13 is changed from the rich side to the lean side, and is defined by a negative value. Therefore, at step 407, only when CDLY<TDL does the control proceed to step 408, which causes CDLY to be TDL, and then to step 409, which causes a first air-fuel ratio flag F1 to be "0" (lean state). On the other hand, if $V_1 > V_{R1}$, which means that the current air-fuel ratio is rich, the control proceeds to step 410, which determines whether or not the value of the delay counter CDLY is negative. If CDLY<0, the control proceeds to step 411, which clears the delay counter CDLY, and then proceeds to step 412. If CDLY≧0, the control directly proceeds to 412. At step 412, the delay counter CDLY is counted up by 1, and at step 413, it is determined whether or not CDLY>TDR. Note that TDR is a rich delay time period for which a lean state is maintained even after the output of the upstream-side $O_2$ sensor 13 is changed from the lean side to the rich side, and is defined by a positive value. Therefore, at step 413, only when CDLY>TDR does the control proceed to step 414, which causes CDLY to the TDR, and then to step 415, which causes the first air-fuel ratio flag F1 to be "1" (rich state).

Next, at step 416, it is determined whether or not the first air-fuel ratio flag F1 is reversed, i.e., whether or not the delayed air-fuel ratio detected by the upstream-side $O_2$ sensor 13 is reversed. If the first air-fuel ratio flag Fl is reversed, the control proceeds to steps 417 to 419, which carry out a skip operation.

At step 417, if the flag F1 is "0" (lean) the control proceeds to step 418, which remarkably increases the correction amount FAF1 by a rich skip amount RSR. Also, if the flag F1 is "1" (rich) at step 417, the control proceeds to step 419, which remarkably decreases the correction amount FAF1 by a lean skip amount RSL.

On the other hand, if the first air-fuel ratio flag F1 is not reversed at step 416, the control proceeds to step 420 to 422, which carries out an integration operation. That is, if the flag F1 is "0" (lean) at step 420, the control proceeds to step 421, which gradually increases the correction amount FAF1 by a rich integration amount KIR. Also, if the flag F1 is "1" (rich) at step 420, the control proceeds to step 422, which gradually decreases the correction amount FAF1 by a lean integration amount KIL.

The correction amount FAF1 is guarded by a minimum value 0.8 at steps 423 and 424. Also, the correction amount FAF1 is guarded by a maximum value 1.2 at steps 425 and 426. Thus, the controlled air-fuel ratio is prevented from becoming overlean or overrich.

The correction amount FAF1 is then stored in the RAM 105, thus completing this routine of FIG. 4 at steps 428.

Figures 5A, 5B, 5C, 5D:
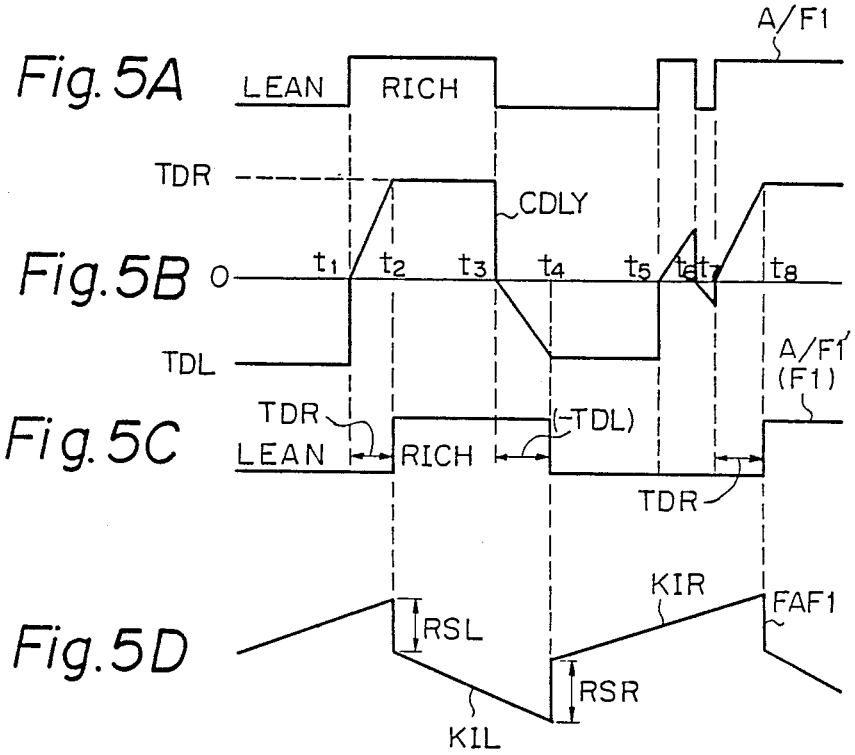
FIGS. 5A through 5D are timing diagrams explaining the flow chart of FIG. 4.

The operation by the flow chart of FIG. 4 will be further explained with reference to FIGS. 5A through 5D. As illustrated in FIG. 5A, when the air-fuel ratio A/F is obtained by the output of the upstream-side $O_2$ sensor 13, the delay counter CDLY is counted up during a rich state, and is counted down during a lean state, as illustrated in FIG. 5B. As a result, a delayed air-fuel ratio corresponding to the first air-fuel ratio flag F1 is obtained as illustrated in FIG. 5C. For example, at time $t_1$, even when the air-fuel ratio A/F is changed from the lean side to the rich side, the delayed air-fuel ratio A/F' (F1) is changed at time $t_2$ after the rich delay time period TDR. Similarly, at time $t_3$, even when the air-fuel ratio A/F is changed from the rich side to the lean side, the delayed air-fuel ratio F1 is changed at time $t_4$ after the lean delay time period TDL. However, at time $t_5$, $t_6$, or $t_7$, when the air-fuel ratio A/F is reversed within a shorter time period than the rich delay time period TDR or the lean delay time period TDL, the delay air-fuel ratio A/F' is reversed at time $t_8$. That is, the delayed air-fuel ratio A/F' is stable when compared with the air-fuel ratio A/F. Further, as illustrated in FIG. 5D, at every change of the delayed air-fuel ratio A/F' from the rich side to the lean side, or vice versa, the correction amount FAF is skipped by the skip amount RSR or RSL, and in addition, the correction amount FAF1 is gradually increased or decreased in accordance with the delayed air-fuel ratio A/F'.

Air-fuel ratio feedback control operations by the downstream-side $O_2$ sensor 15 will be explained. There are two types of air-fuel ratio feedback control operations by the downstream-side $O_2$ sensor 15, i.e., the operation type in which a second air-fuel ratio correction amount FAF2 is introduced thereinto, and the operation type in which an air-fuel ratio feedback control parameter in the air-fuel ratio feedback control operation by the upstream-side $O_2$ sensor 13 is variable. Further, as the air fuel ratio feedback control parameter, there are nominated a delay time period TD (in more detail, the rich delay time period TDR and the lean delay time period TDL), a skip amount RS (in more detail, the rich skip amount RSR and the lean skip amount RSL), an integration amount KI (in more detail, the rich integration amount KIR and the lean integration amount KIL), and the reference volta $V_{R1}$.

For example, if the rich delay time period becomes longer than the lean delay time period (TDR>(−TDL)), the controlled air-fuel becomes richer, and if the lean delay time period becomes longer than the rich delay time period ((−TDL)>TDR), the controlled air-fuel ratio becomes leaner. Thus, the air-fuel ratio can be controlled by changing the rich delay time period TDR1 and the lean delay time period (−TDL) in accordance with the output of the downstream-side $O_2$ sensor 15. Also, if the rich skip amount RSR is increased or if the lean skip amount RSL is decreased, the controlled air-fuel ratio becomes richer, and if the lean skip amount RSL is increased or if the rich skip amount RSR is decreased, the controlled air-fuel ratio becomes leaner. Thus, the air-fuel ratio can be controlled by changing the rich skip amount RSR and the lean skip amount RSL in accordance with the output downstream-side $O_2$ sensor 15. Further, if the rich integration amount KIR is increased or if the lean integration amount KIL is decreased, the controlled air-fuel ratio becomes richer, and if the lean integration amount KIL is increased or if the rich integration amount KIR is decreased, the controlled air-fuel ratio becomes leaner. Thus, the air-fuel ratio can be controlled by changing the rich integration amount KIR and the lean integration amount KIR in accordance with the output of the downstream-side $O_2$ sensor 15. Still further, if the reference voltage $V_{R1}$ is increased, the controlled air-fuel ratio becomes richer, and if the reference voltage $V_{R1}$ is decreased, the controlled air-fuel ratio becomes leaner. Thus, the air-fuel ratio can be controlled by changing the reference voltage $V_{R1}$ in accordance with the output of the downstream-side $O_2$ sensor 15.

There are various merits in the control of the air-fuel ratio feedback control parameters by the output $V_2$ of the downstream-side $O_2$ sensor 15. For example, when the delay time periods TDR and TDL are controlled by the output $V_2$ of the downstream-side $O_2$ sensor 15, it is possible to precisely control the air-fuel ratio. Also, when the skip amounts RSR and RSL are controlled by the output $V_2$ of the downstream-side $O_2$ sensor 15, it is possible to improve the response speed of the air-fuel ratio feedback control by the output $V_2$ of the downstream-side $O_2$ sensor 15. Of course, it is possible to simultaneously control two or more kinds of the air-fuel ratio feedback control parameters by the output $V_2$ of the downstream-side $O_2$ sensor 15.

A double $O_2$ sensor system into which a second air-fuel ratio correction amount FAF2 is introduced will be explained with reference to FIGS. 6 and 7.

Figures 6, 6A:
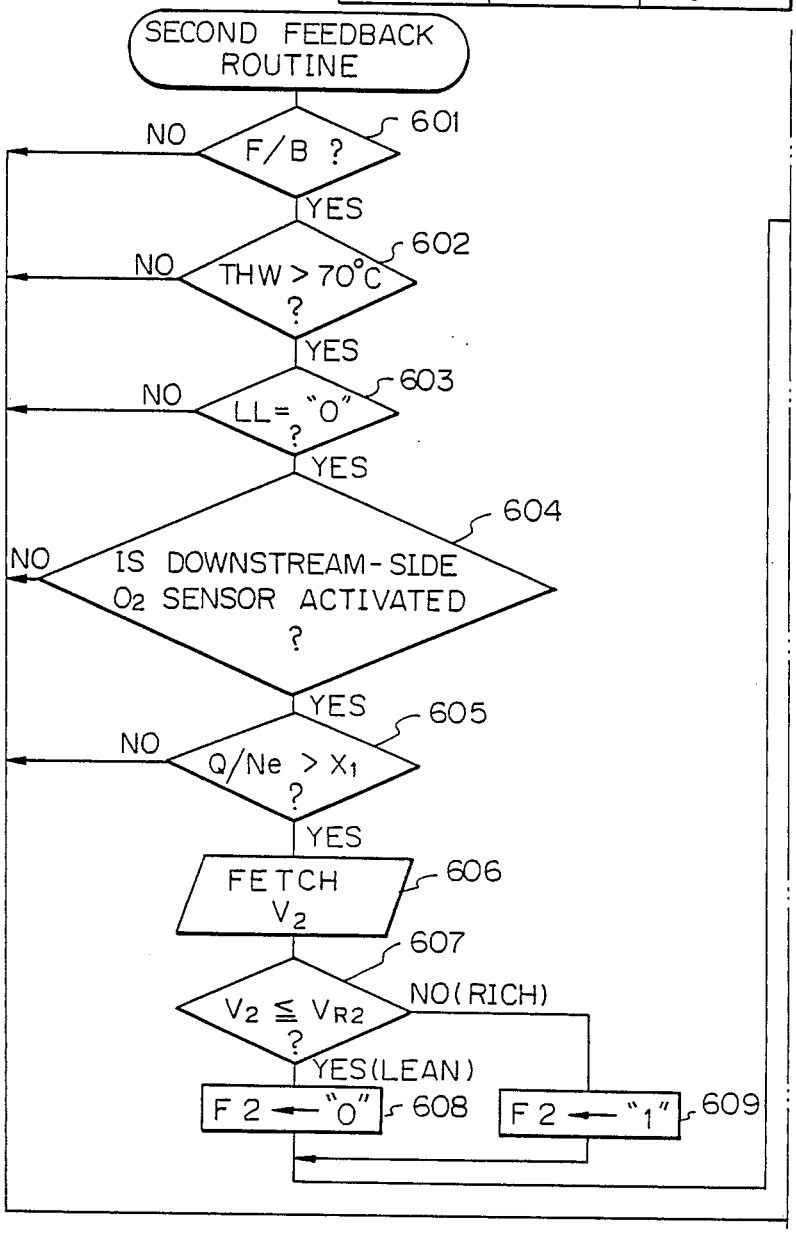
Figure 6B:
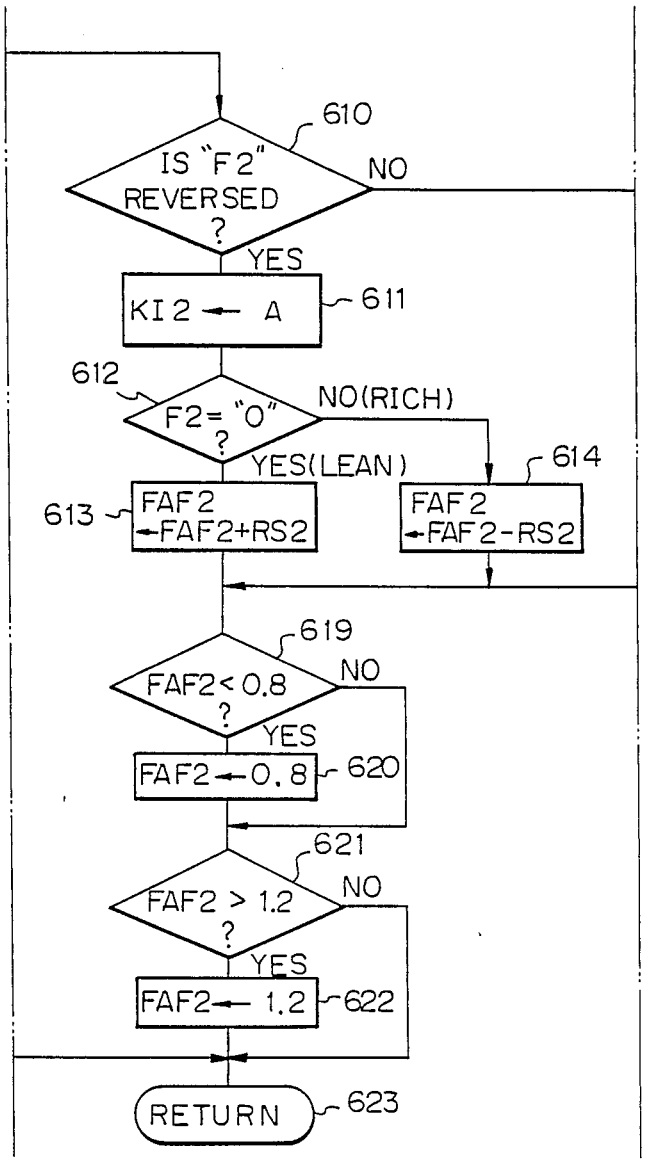
Figure 6C:
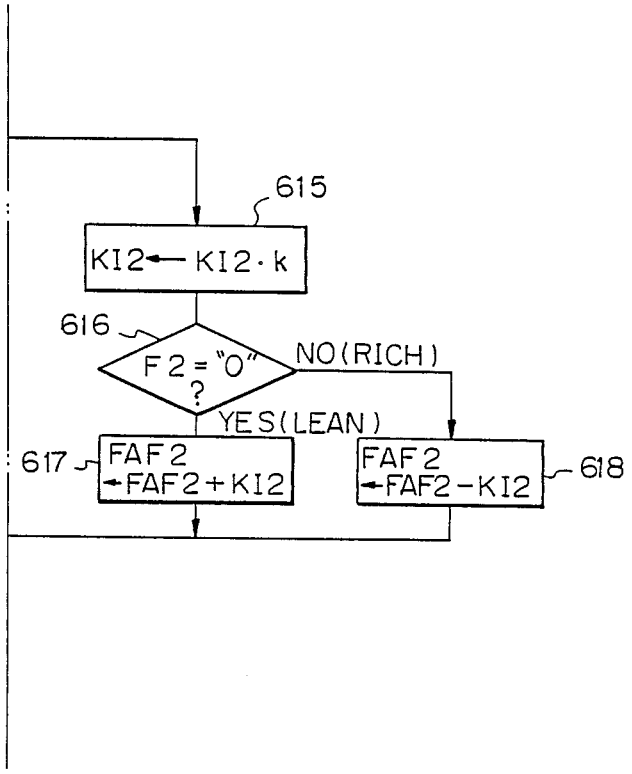

FIG. 6 is a routine for calculating a second air-fuel ratio feedback correction amount FAF2 in accordance with the output of the downstream-side $O_2$ sensor 15 executed at every predetermined time period such as 1 s.

At steps 601 through 605, it is determined whether or not all of the feedback control (closed-loop control) conditions by the downstream-side $O_2$ sensor 15 are satisfied. For example, at step 601, it is determined whether or not the feedback control conditions by the upstream-side $O_2$ sensor 13 are satisfied. At step 602, it is determined whether or not the coolant temperature THW is higher than 70° C. At step 603, it is determined whether or not the throttle valve 16 is open (LL="0"). At step 604, it is determined whether or not the output of the downstream-side $O_2$ sensor 15 has been once changed from the lean side to the rich side or vice versa. At step 605, it is determined whether or not a load parameter such as Q/Ne is larger than a predetermined value $X_1$. Of course, other feedback control conditions are introduced as occasion demands. However, an explanation of such other feedback control conditions is omitted.

If one or more of the feedback control conditions is not satisfied, the control proceeds directly to step 623, thereby carrying out an open-loop control operation. Note that, in this case, the amount FAF2 or a mean value FAF2 thereof is stored in the backup RAM 106, and in an open-loop control operation, the value FAF2 or FAF2 is read out of the backup RAM 106.

Contrary to the above, if all of the feedback control conditions are satisfied, the control proceeds to step 606.

At step 606, an A/D conversion is performed upon the output voltage $V_2$ of the downstream-side $O_2$ sensor 15, and the A/D converted value thereof is then fetched from the A/D converter 101. Then, at step 607, the voltage $V_2$ is compared with a reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference volta $V_{R2}$ (=0.55 V) is preferably higher that the reference voltage $V_{R1}$ (=0.45 V), in consideration of the difference in output characteristics and deterioration speed between the $O_2$ sensor 13 upstream of the catalyst converter 12 and the $O_2$ sensor 15 downstream of the catalyst converter 12. However, the voltage $V_{B2}$ can be voluntarily determined.

At step 607, if the air-fuel ratio downstream of the catalyst converter 12 is lean, the control proceeds to step 608 which resets a second air-fuel ratio flag F2. Alternatively, the control proceeds the step 609, which sets the second air-fuel ratio flag F2.

Next, at step 610, it is determined whether or not the second air-fuel ratio flag F2 is reversed, i.e., whether or not the air-fuel ratio detected by the downstream-side $O_2$ sensor 15 is reversed. If the second air-fuel ratio flag F2 is reversed, the control proceeds to steps 611 to 614 which perform a skip operation upon an integration amount KI2 and a skip operation upon the second air-fuel ratio correction amount FAF2. That is, at step 611, an initial value A which represents a speed skip amount is set in the integration amount KI2. Note that the value A is definite, however, this value can vary in accordance with a load parameter such as the intake air amount Q and the engine speed $N_e$. Then, if the flag F2 is "0" (lean) at step 612, the control proceeds to step 613, which remarkably increases the second correction amount FAF2 by a skip amount RS2. Also, if the flag F2 is "1" (rich) at step 612, the control proceeds to step 614, which remarkably decreases the second correction amount FAF2 by the skip amount RS2. On the other hand, if the second air-fuel ratio flag F2 is not reversed at step 610, the control proceeds to steps 615 to 618, which perform a gradual decreasing operation (integration operation) upon the integration amount KI2 and perform an integration operation upon the second air-fuel ratio correction amount FAF2. That is, at step 615, the integration amount KI2 is multiplied by a predetermined ratio k(<1) by $$KI2 \leftarrow KI2 \cdot k.$$

Therefore, when the routine of FIG. 6 is carried out n times after the second air-fuel ratio flag F2 is reversed, $KI2 = A \cdot k^n$. As a result, the integration amount KI2 is remarkably increased at a switching of the output $V_2$ of the downstream-side $O_2$ sensor 15, and thereafter, the integration amount KI2 is gradually decreased. Then, if the flag F2 is "0" (lean) at step 610, the control proceeds to step 617, which gradually increases the second correction amount FAF2 by the integration amount KI2. Also, if the flag F2 is "1" (rich) at step 616, the control proceeds to step 618, which gradually decreases the second correction amount FAF2 by the integration amount KI2.

Note that the skip amount RS2 is larger than the integration amount KI2.

The second correction amount FAF2 is guarded by a minimum value 0.8 at steps 619 and 620, and by a maximum value 1.2 at steps 621 and 622, thereby also preventing the controlled air-fuel ratio from becoming overrich or overlean.

The correction amount FAF2 is then stored in the backup RAM 106, thus completing this routine of FIG. 6 at step 623.

Figure 7:
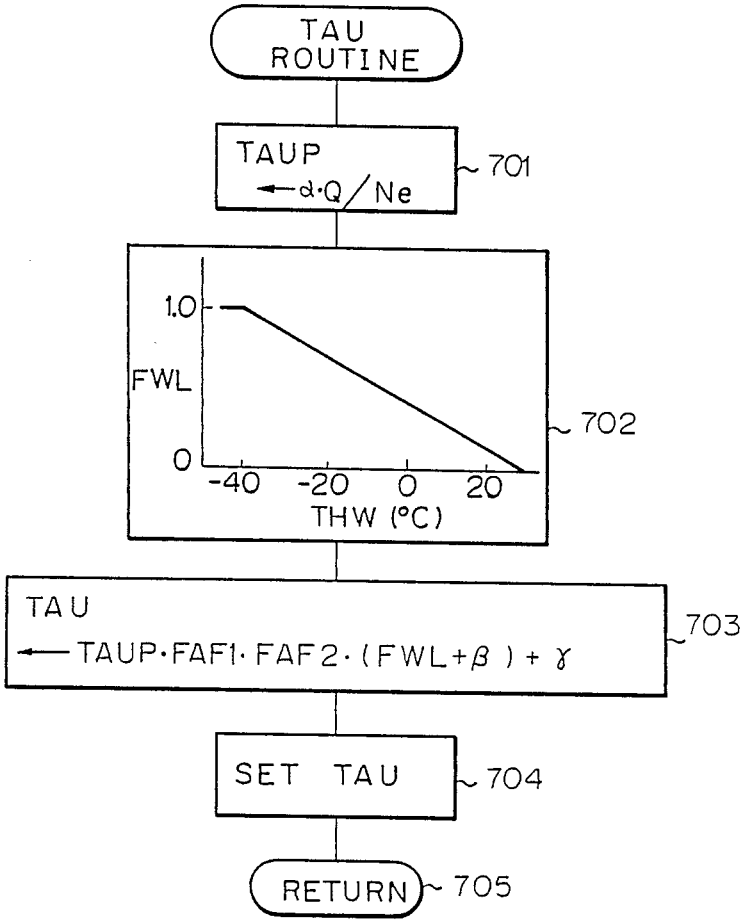

FIG. 7 is a routine for calculating a fuel injection amount TAU executed at every predetermined crank angle such as 360° CA. At step 701, a base fuel injection amount TAUP is calculated by using the intake air amount data Q and the engine speed data Ne stored in the RAM 105. That is, $$TAUP \leftarrow \alpha \cdot Q/Ne$$

where $\alpha$ is a constant. Then at step 702, a warming-up incremental amount FWL is calculated from a one-dimensional map stored in the ROM 104 by using the coolant temperature data THW stored in the RAM 105. Note that the warming-up incremental amount FWL decreases when the coolant temperature THW increases. At step 703, a final fuel injection amount TAU is calculated by $$TAU \leftarrow TAUP \cdot FAF1 \cdot FAF2 \cdot (FWL + \beta) + \gamma$$

where 62 and $\gamma$ are correction factors determined by other parameters such as the voltage of the battery and the temperature of the intake air. At step 704, the final fuel injection amount TAU is set in the down counter 107, and in addition, the flip-flop 108 is set to initiate the activation of the fuel injection valve 7. Then, this routine is completed by step 605. Note that, as explained above, when a time period corresponding to the amount TAU has passed, the flip-flop 109 is reset by the carry-out signal of the down counter 108 to stop the activation of the fuel injection valve 7.

Figures 8A, 8B, 8C, 8D, 8E, 8F, 8G, 8H, 8I:
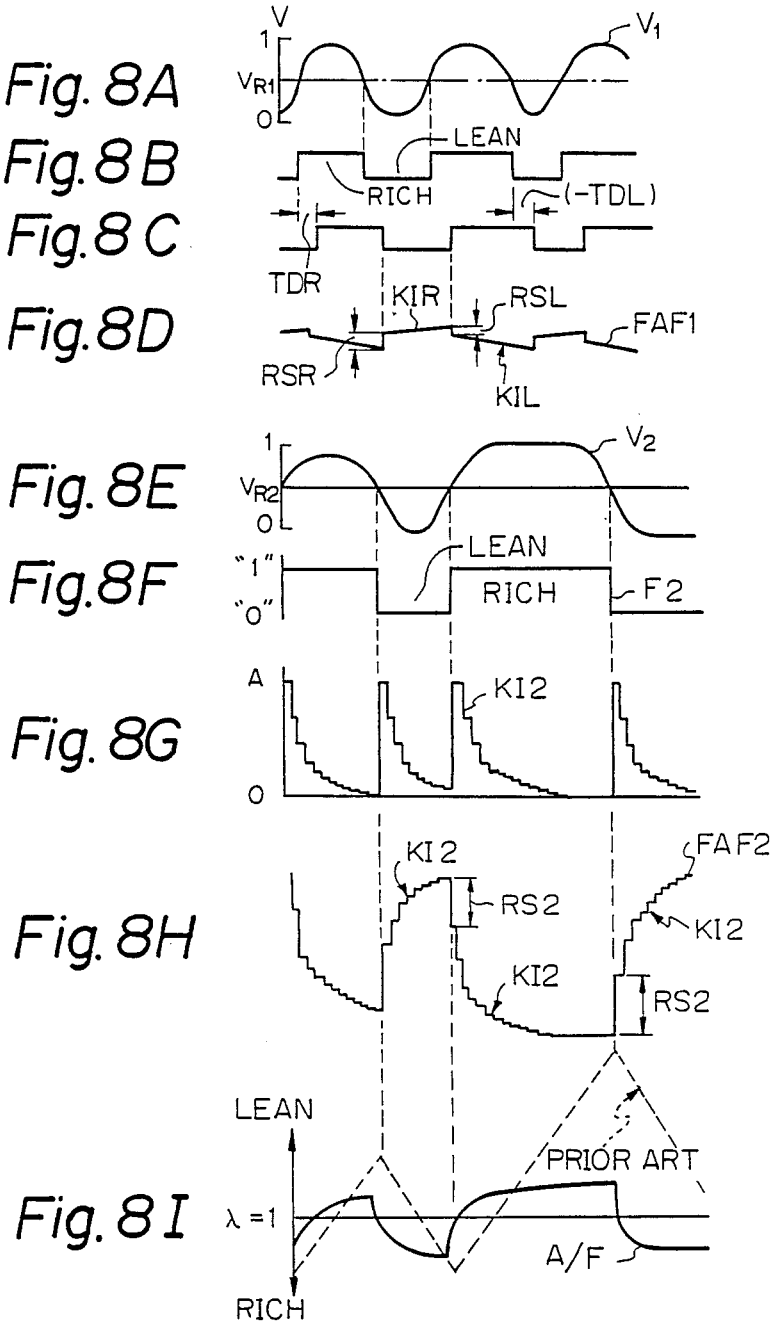
FIGS. 8A through 8I are timing diagrams explaining the flow charts of FIGS. 4, 6, and 7.

FIGS. 8A through 8I are timing diagrams for explaining the controlled air-fuel ratio obtained by the flow charts of FIGS. 4, 6, and 7. In this case, the engine is in a closed-loop control state for the two $O_2$ sensors 13 and 15. When the output $V_1$ the upstream-side $O_2$ sensor 13 is changed as illustrated in FIG. 8A, the determination at step 403 of FIG. 4 is shown in FIG. 8B, and a delayed determination thereof corresponding to the first air-fuel ratio flag F1 is shown in FIG. 8C. As a result, as shown in FIG. 8D, every time the delayed determination is changed from the rich side to the lean side, or vice versa, the first air-fuel ratio correction amount FAF1 is skipped by the amount RSR or RSL. Otherwise, the first air-fuel ratio correction amount FAF1 is gradually changed by the amount KIR or KIL.

On the other hand, when the output $V_2$ of the downstream-side $O_2$ sensor 15 is changed as illustrated in FIG. 8E, the determination at 608 of FIG. 6 corresponding to the second air-fuel ratio flag F2 is shown in FIG. 8F. As a result, the integration amount KI2 is changed as illustrated in FIG. 8G. That is, the integration amount KI2 is skipped every time the second air-fuel ratio flag F2 is reversed, and thereafter, the integration amount KI2 is gradually decreased. Further, the second air-fuel ratio correction amount FAF2 is changed as illustrated in FIG. 8H. That is, every time the second air-fuel ratio flag F2 is reversed, the second air-fuel ratio correction amount FAF2 is skipped by the skip amount RS2. Also, immediately after the second air-fuel ratio flag F2 is reversed, the speed of renewal of the second air-fuel ratio correction amount FAF2 is rather high, and thereafter, this speed is gradually decreased. The second air-fuel ratio correction amount FAF2 as changed in FIG. 8H directly affects the controlled air-fuel ratio, so that the air-fuel ratio A/F upstream of the catalyst converter 12 is changed as illustrated in FIG. 8I. That is, the air-fuel ratio A/F is rapidly changed when the second air-fuel ratio flag F2 is reversed, and thereafter, the air-fuel ratio A/F is slowly changed, thus reducing the amplitude of the air-fuel ratio A/F. Note, if the integration amount KI2 is definite as in the prior art, the air-fuel ratio A/F upstream of the catalyst converter 12 is changed as indicated by the dotted lines in FIG. 8I.

Figure 9:
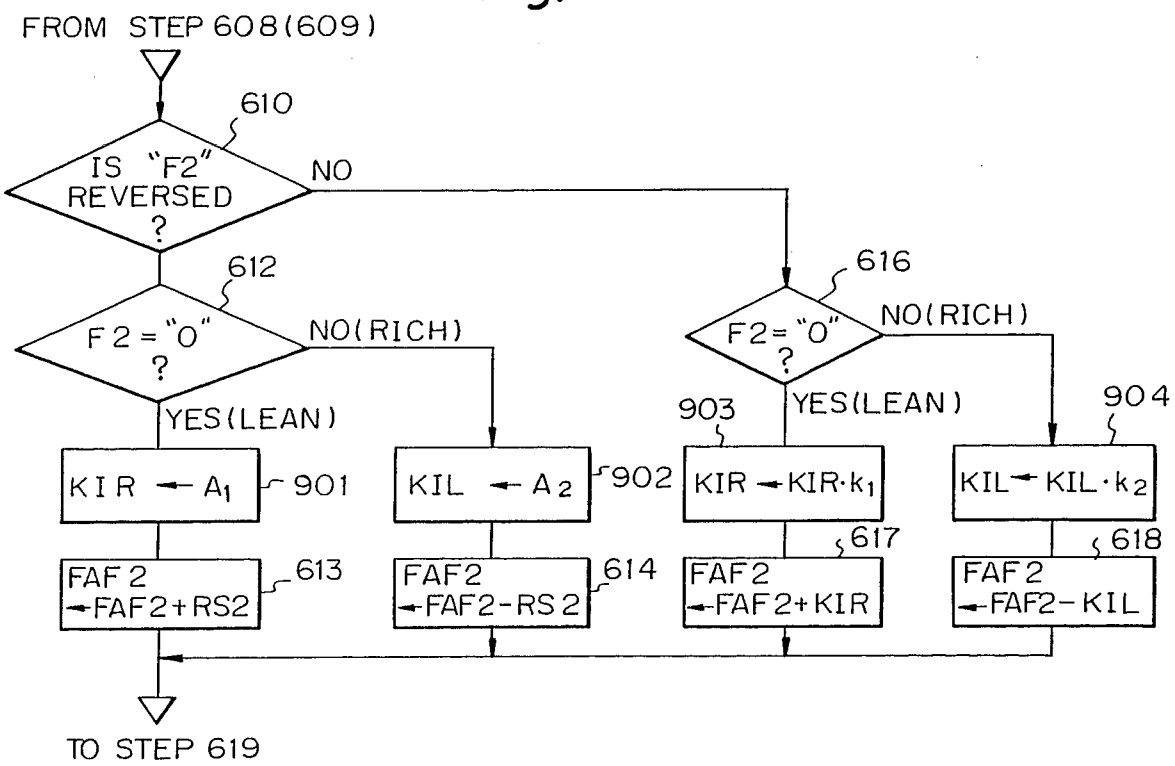

In FIG. 9, which is a modification of FIG. 6, steps 901 through 904 are provided instead of steps 611 and 615. That is, at step 610, if the second air-fuel ratio flag F2 is reversed, the control proceeds to steps 612, 901, 613, 902, and 614 which perform a skip operation upon integration amounts KIR and KIL and a skip operation upon the second air-fuel ratio correction amount FAF2. That is, at step 612, it is determined whether or not the air-fuel ratio detected by the downstream-side $O_2$ sensor 15 is lean (F2="0"). As a result, if F2="0" (lean), the control proceeds to step 901 which sets an initial value $A_1$ in the rich integration amount KIR. Note, the value $A_1$ is also definite, but this value can vary in accordance with a load parameter such as the intake air amount Q and the engine speed Ne. Then, at step 613, the second air-fuel ratio correction amount FAF2 is skipped by the skip amount RS2. Conversely, if F2="1" (rich) at step 612, the control proceeds to step 902 which sets an initial value $A_2$ in the lean integration amount KIL. Note, the value $A_2$ is also definite, but can vary in accordance with a load parameter such as the intake air amount Q and the engine speed Ne. Then, at step 614, the second air-fuel ratio correction amount FAF2 is skipped by the skip amount RS2. On the other hand, at step 610, if the second air-fuel ratio flag F2 is not reversed, the control proceeds to steps 616, 903, 617, 904, and 618 which perform a gradual decreasing operation (integration operation) upon the integration amounts KIR and KIL, and perform an integration operation upon the second air-fuel ratio correction amount FAF2. That is, at step 616, it is determined whether or not the air-fuel ratio detected by the downstream-side air-fuel ratio sensor 15 is lean (F2="0" ). As a result, if F2="0", the control proceeds to step 903 which multiplies the rich integration amount KIR by a predetermined ratio $k_1$ (<1), i.e., $$KIR \leftarrow KIR \cdot k_1.$$

Therefore, the routine of FIG. 9 is carried out n times after the second air-fuel ratio flag F2 is switched from "1" to "0", $KIR = A_1 \cdot k_1^n$. Then, at step 617, the second air-fuel ratio correction FAF2 is gradually increased by the rich integration amount KIR. Contrary to this, if F2="1" at step 616, the control proceeds to step 904 which multiplies the lean integration amount KIL by a predetermined ratio $k_2$ (<1), i.e., $$KIL \leftarrow KIL \cdot k_2.$$

Therefore, the routine of FIG. 9 is carried out n times after the second air-fuel ratio flag F2 is switched from "0" to "1", $KIL = A_2 \cdot k_2^n$. Then, at step 618, the second air-fuel ratio correction amount FAF is gradually decreased by the lean integration amount KIL.

Note that the rich integration amount KIR and the lean integration amount KIL are asymmetrical in the routine of FIG. 9. For example, $A_1 > A_2$ and $k_1 > k_2$, thereby promptly returning the controlled air-fuel ratio deviated to the lean side to the stoichiometric air-fuel ratio, thus reducing the $NO_X$ emission in particular.

Figures 10A, 10B, 10C, 10D, 10E:
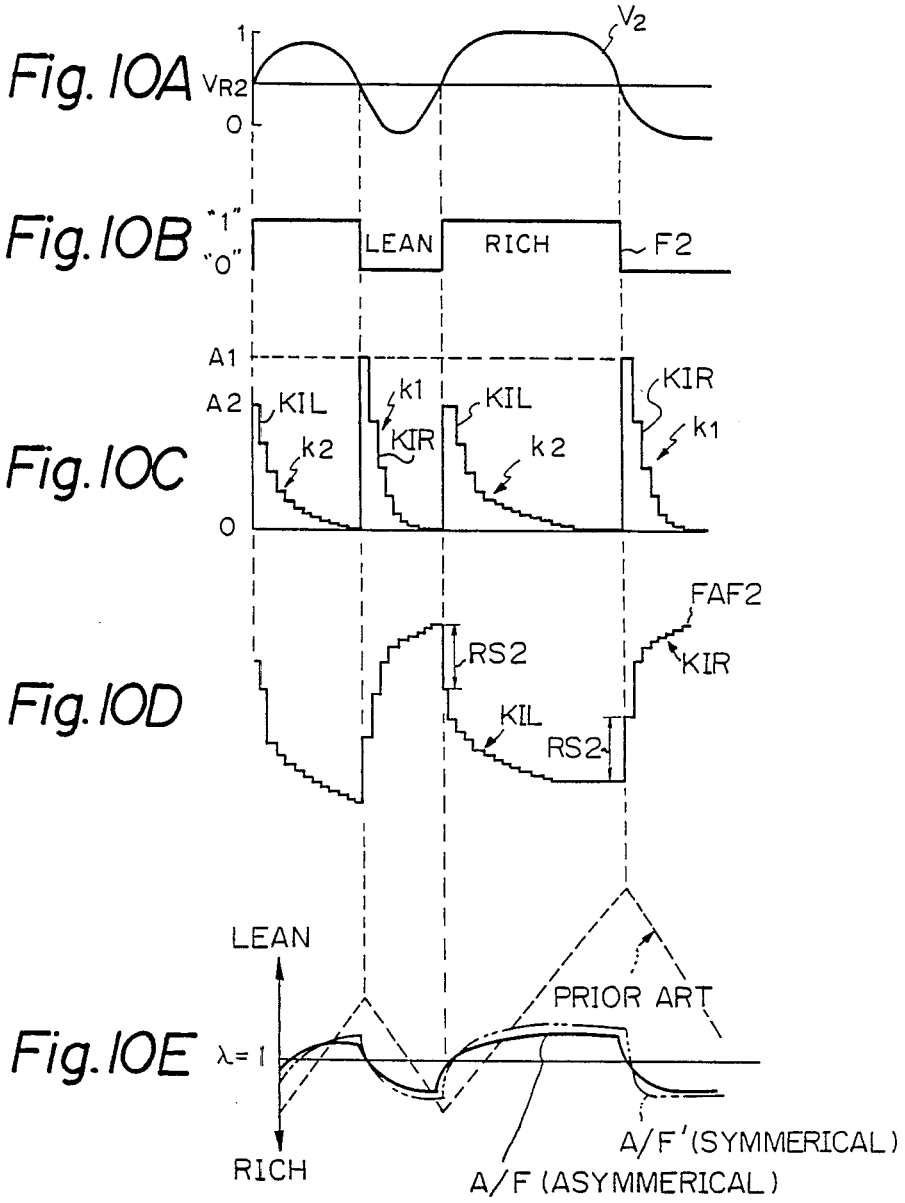
FIGS. 10A through 10E are timing diagrams explaining the flow charts of FIG. 9.

FIGS. 10A through 10E are timing diagrams explaining the routine of FIG. 9. Note, FIGS. 10A through 10E correspond to FIGS. 8E through 8I, respectively. That is, when the output $V_2$ of the downstream-side $O_2$ sensor 15 is changed as shown in FIG. 10A, and accordingly, the second air-fuel ratio flag F2 is changed as shown in FIG. 10B, the change of the lean integration amount KIL is asymmetrical to the change of the rich integration amount KIL as shown in FIG. 10C, since $A_1 > A_2$ and $k_1 > k_2$. The asymmetrical change of the integration amounts KIR and KIL affects the second air-fuel ratio correction amount FAF2 as illustrated in FIG. 10D. Also, the second air-fuel ratio correction amount FAF2 directly affects the controlled air-fuel ratio, so that the air-fuel ratio A/F upstream of the catalyst converter 12 is changed as indicated by the solid line in FIG. 10E. That is, the amplitude of the air-fuel ratio A/F is smaller than the air-fuel ratio A/F′ where the change of the integration amounts are made symmetrical by the routine of FIG. 6. Particularly, the deviation of the air-fuel ratio to the lean side is reduced, thereby decreasing the $NO_X$ emission.

A double $O_2$ sensor system, in which an air-fuel ratio feedback control parameter of the first air-fuel ratio feedback control by the upstream-side $O_2$ sensor is variable, will be explained with reference to FIGS. 11 and 12. In this case, the skip amounts RSR and RSL as the air-fuel ratio feedback control parameters are variable.

Figures 11, 11A:
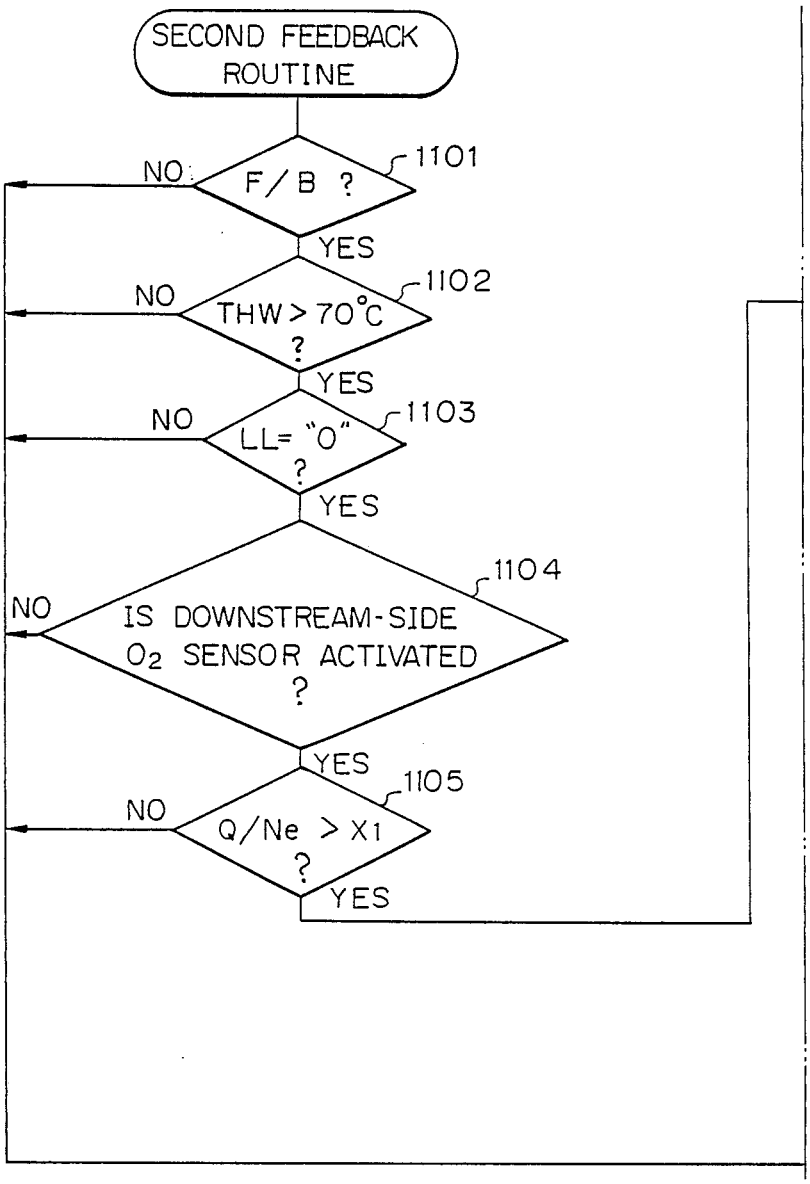
Figure 11B:
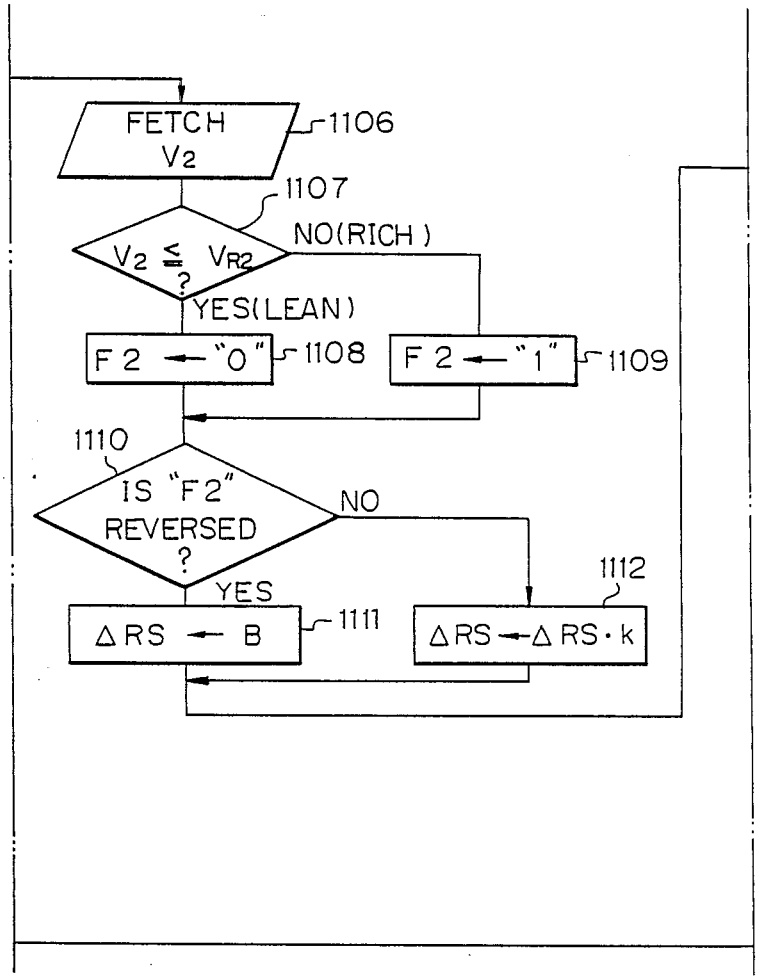
Figure 11C:
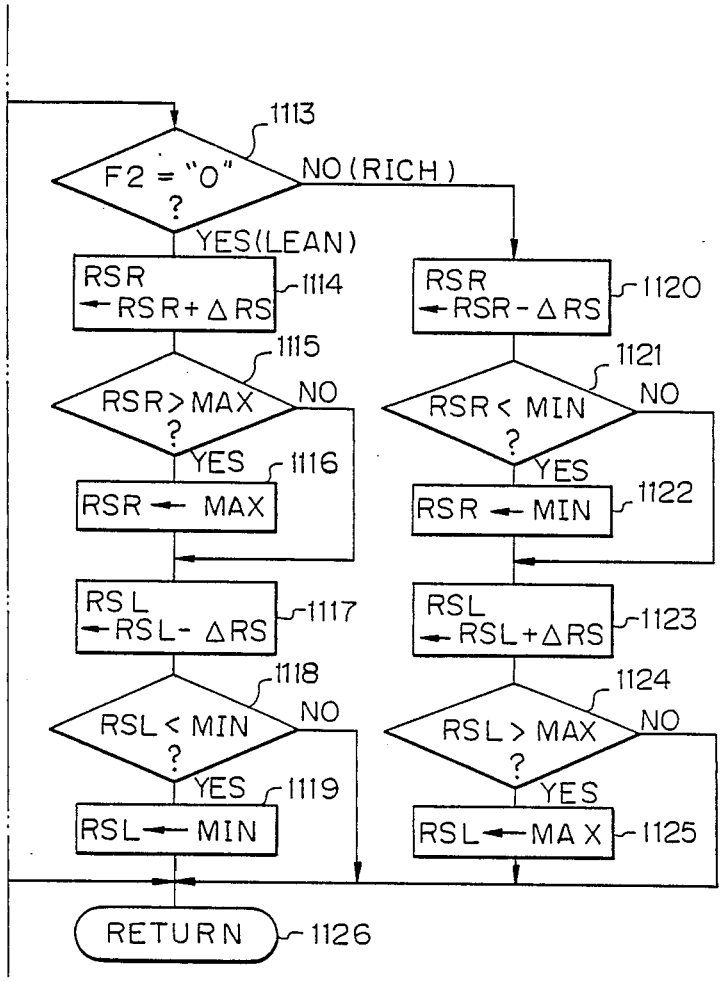

FIG. 11 is a routine for calculating the skip amounts RSR and RSL in accordance with the output of the downstream-side $O_2$ sensor 15 executed at every predetermined time period such as 1 s.

Steps 1101 through 1109 are the same as steps 601 through 610 of FIG. 6. That is, if one or more of the feedback control conditions is not satisfied, the control proceeds directly to step 1126, thereby carrying out an open-loop control operation. Note that, in this case, the amounts RSR and RSL or the mean values $\overline{RSR}$ and $\overline{RSL}$ thereof are stored in the backup RAM 106, and in an open-loop control operation, the values RSR and RSL or $\overline{RSR}$ and $\overline{RSL}$ are read out of the backup RAM 106.

Contrary to the above, if all of the feedback control conditions are satisfied, the second air-fuel ratio flag F2 is determined by the routine of steps 1106 through 1109.

Next, at step 1110, it is determined whether or not the second air-fuel ratio flag F2 is reversed, i.e., the air-fuel ratio downstream of the catalyst converter 12 is reversed. If the second air-fuel ratio flag F2 is reversed, the control proceeds to step 1111 which sets an initial value B in a speed ΔRS of renewal of the skip amounts RSR and RSL. That is, the speed ΔRS is skipped by the value B. Note that the value B is definite, but can vary in accordance with a load parameter such as the intake air amount Q and the engine speed Ne. Conversely, if the second air-fuel ratio flag F2 is not reversed, the control proceeds to step 1112 which multiplies the speed ΔRS by a predetermined ratio k (<1) by $$\Delta RS \leftarrow \Delta RS \cdot k.$$

Therefore, when the routine of FIG. 11 is carried out n times after the output of the second air-fuel ratio flag F2 is reversed, $\Delta RS = B \cdot k^n$. As a result, the speed ΔRS is remarkably increased at a switching of the output $V_2$ of the downstream-side $O_2$ sensor 15, and thereafter, the speed ΔRS is gradually decreased.

At step 1113, it is determined whether or not the second air-fuel ratio F2 is "0". If F2="0", which means that the air-fuel ratio downstream of the catalyst converter 12 is lean, the control proceeds to steps 1114 through 1119, and if F2="1", which means that the air-fuel ratio downstream of the catalyst converter 12 is rich, the control proceeds to steps 1120 through 1125.

At step 1114, the rich skip amount RSR is increased by the speed ΔRS to move the air-fuel ratio to the rich side. At steps 1115 and 1116, the rich skip amount RSR is guarded by a maximum value MAX which is, for example, 7.5%.

At step 1117, the lean skip amount RSL is decreased by the speed ΔRS to move the air-fuel ratio to the rich side. At steps 1118 and 1119, the lean skip amount RSL is guarded by a minimum value MIN which is, for example, 2.5%.

On the other hand, if F2="1" (rich), at step 1120, the rich skip amount RSR is decreased by the speed ΔRS to move the air-fuel ratio to the lean side. At steps 1121 and 1122, the rich skip amount RSR is guarded by the minimum value MIN. Further, at step 1123, the lean skip amount RSL is decreased by the speed ΔRS to move the air-fuel ratio to the rich side. At steps 1124 and 1125, the lean skip amount RSL is guarded by the maximum value MAX.

The skip amounts RSR and RSL are then stored in the backup RAM 106, thereby completing this routine of FIG. 11 at step 1126.

In FIG. 11, the minimum value MIN is a level by which the transient characteristics of the skip operation using the amounts RSR and RSL can be maintained, and the maximum value MAX is a level by which the drivability is not deteriorated by the fluctuation of the air-fuel ratio.

Figure 12:
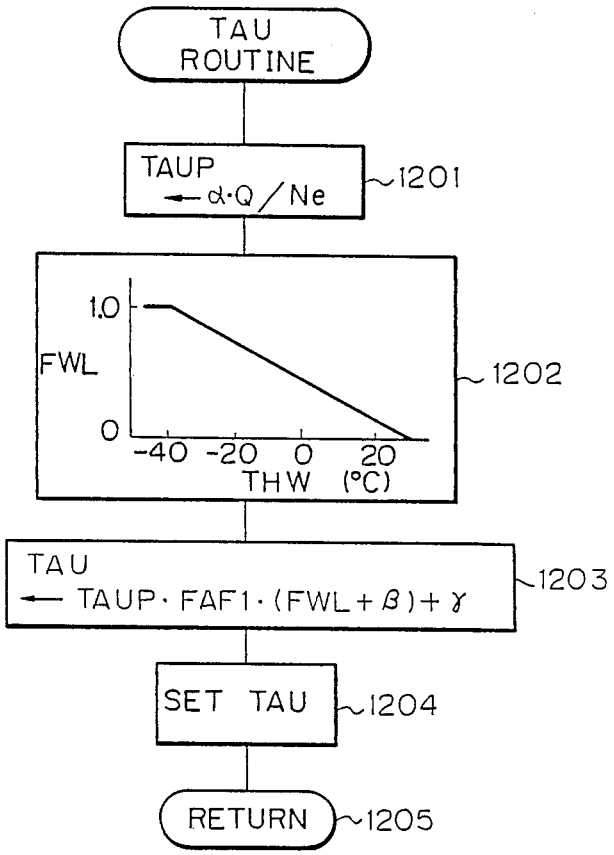

FIG. 12 is a routine for calculating a fuel injection amount TAU executed at every predetermined crank angle such as 360° CA. At step 1201, a base fuel injection amount TAUP is calculated by using the intake air amount data Q and the engine speed data Ne stored in the RAM 105. That is, $$TAUP \leftarrow \alpha \cdot Q/Ne$$

where α is a constant. Then at step 1202, a warming-up incremental amount FWL is calculated from a one-dimensional map by using the coolant temperature data THW stored in the RAM 105. Note that the warming-up incremental amount FWL decreased when the coolant temperature THW increases. At step 1203, a final fuel injectional amount TAU is calculated by $$TAU \leftarrow TAUP \cdot FAF1 \cdot (FWL + \beta) + \gamma$$

where β and γ are correction factors determined by other parameters such as the voltage of the battery and the temperature of the intake air. At step 1204, the final fuel injection amount TAU is set in the down counter 108, and in addition, the flip-flop 109 is set to initiate the activation of the fuel injection valve 7. This routine is then completed by step 1205. Note that, as explained above, when a time period corresponding to the amount TAU has passed, the flip-flop 109 is reset by the carry-out signal of the down counter 108 to stop the activation of the fuel injection valve 7.

Figures 13H, 13I, 13J:
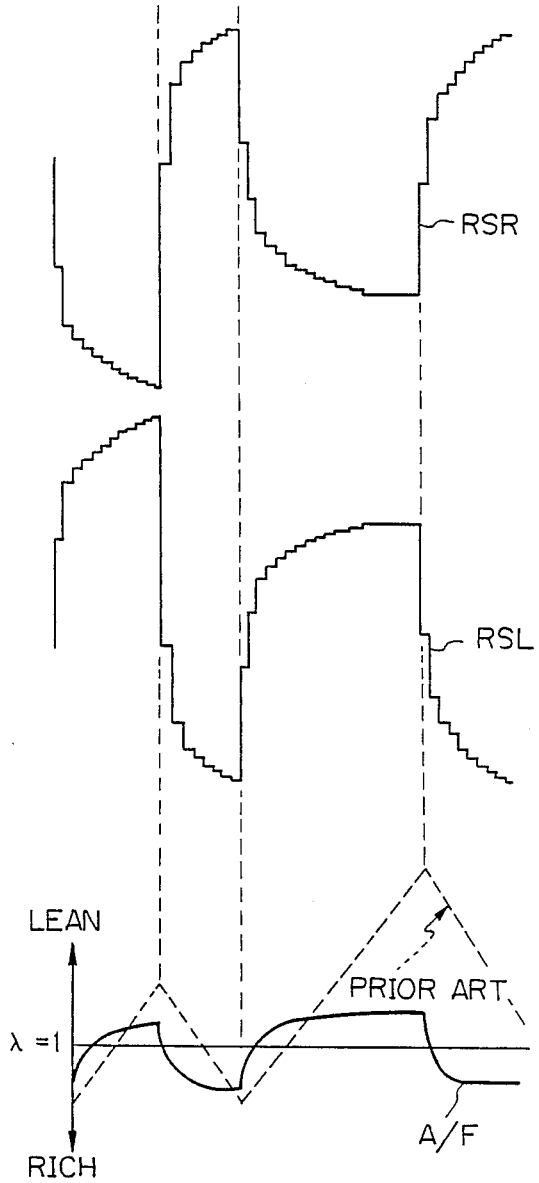

FIGS. 13A through 13J are timing diagrams for explaining the controlled air-fuel ratio obtained by the flow charts of FIGS. 4, 11 and 12. FIGS. 13A through 13F are the same as FIG. 8A through 8F, respectively. When the output $V_2$ of the downstream-side $O_2$ sensor 15 is changed as illustrated in FIG. 13E, and accordingly, the second air-fuel ratio flag F2 is changed as illustrated in FIG. 13F, the speed ΔRS is changed as illustrated in FIG. 13G. That is, the speed ΔRS is skipped every time the second air-fuel ratio flag F2 is reversed, and thereafter, the speed ΔRS is gradually decreased. Further, the skip amounts RSR and RSL are changed as illustrated in FIGS. 13H and 13I. That is, when the output $V_2$ of the downstream-side $O_2$ sensor 15 indicates a lean state, the rich skip amount RSR is rapidly increased immediately after the reversion of the second air-fuel ratio flag F2, and thereafter, the rich skip amount RSR is gradually increased. Simultaneously, the lean skip amount RSL is rapidly decreased immediately after the reversion of the second air-fuel ratio flag F2, and thereafter, the lean skip amount RSL is gradually decreased. On the other hand, when the output $V_2$ of the downstream-side $O_2$ sensor 15 indicates a rich state, the rich skip amount RSR is rapidly decreased immediately after the reversion of the second air-fuel ratio flag F2, and thereafter, the rich skip amount RSR is gradually decreased. Simultaneously, the lean skip amount RSL is rapidly increased immediately after the reversion of the second air-fuel ratio flag F2, and thereafter, the lean skip amount RSL is gradually increased. The skip amounts RSR and RSL as changed in FIGS. 13H and 13I affect the air-fuel ratio correction amount FAFl, so that the air-fuel ratio A/F upstream of the catalyst converter 12 is changed as illustrated in FIG. 13J. That is, the air-fuel ratio A/F is rapidly changed when the second air-fuel ratio flag F2 is reversed, and thereafter, the air-fuel ratio A/F is slowly changed, thus reducing the amplitude of the air-fuel ratio A/F. Note, if the speed ΔRS is definite as in the prior art, the air-fuel ratio A/F upstream of the catalyst converter 12 is changed as indicated by the dotted lines in FIG. 13J.

Figure 14:
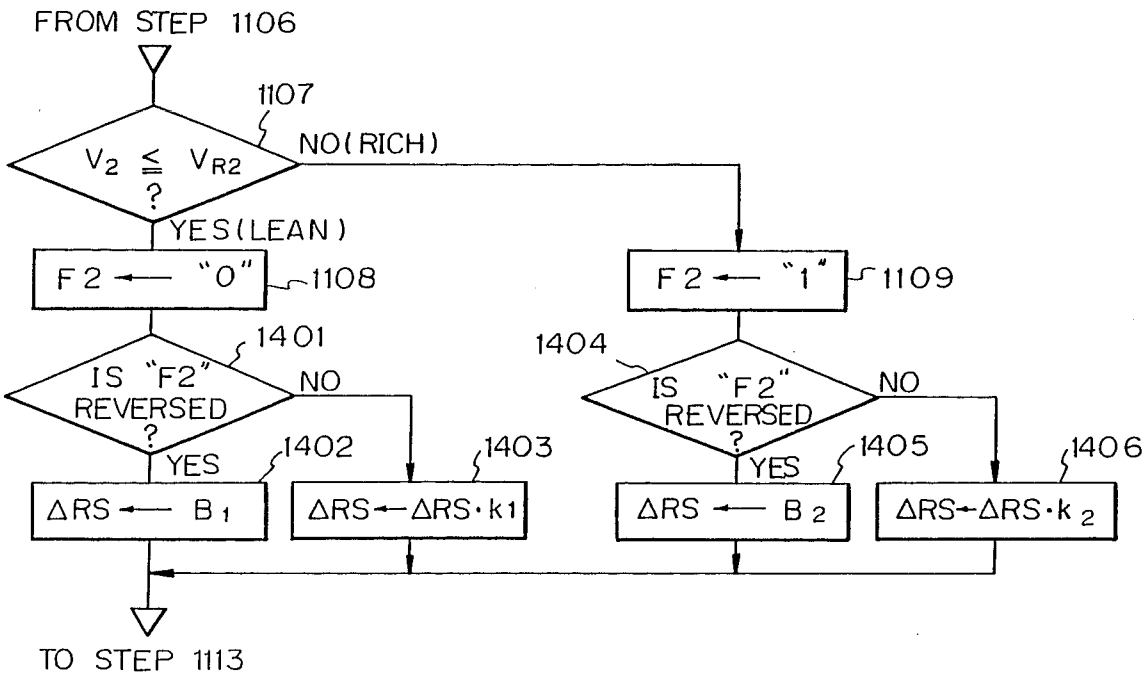

In FIG. 14, which is a modification of FIG. 11, steps 1401 through 1406 are provided instead of steps 1110, 1111, and 1112. That is, at step 1107, if $V_2 \leqq V_{R2}$ (lean), the control proceeds to steps 1108, 1401, 1402, and 1403, while if $V_2 > V_{R2}$ (rich), the control proceeds to steps 1109, 1404, 1405, and 1406.

At step 1108, the second air-fuel ratio flag F2 is reset, and at step 1401, it is determined whether or not the second air-fuel ratio flag F2 is reversed, i.e., the air-fuel ratio downstream of the catalyst converter 12 is reversed. If the second air-fuel ratio flag F2 is reversed, the control proceeds to step 1402 which sets an initial value $B_1$ in a speed ΔRS of renewal of the skip amounts RSR and RSL. That is, the speed ΔRS is skipped by the value $B_1$. Note, the value $B_1$ is definite, but can vary in accordance with a load parameter such as the intake air amount Q and the engine speed Ne. Conversely, if the second air-fuel ratio flag F2 is not reversed, the control proceeds to step 1403 which multiplies the speed ΔRS by a predetermined ratio $k_1$ (<1) by $$\Delta RS \leftarrow \Delta RS \cdot k_1.$$

Therefore, when the routine of FIG. 14 is carried out n times after the output of the second air-fuel ratio flag F2 is reversed, $\Delta RS = B_1 \cdot k_1^n$. As a result, the speed ΔRS is remarkably increased at a switching of the output $V_2$ of the downstream-side $O_2$ sensor 15, and thereafter, the speed ΔRS is gradually decreased.

At step 1109, the second air-fuel ratio flag F2 is set, and at step 1404, it is determined whether or not the second air-fuel ratio flag F2 is reversed, i.e., the air-fuel ratio downstream of the catalyst converter 12 is reversed. If the second air-fuel ratio flag F2 is reversed, the control proceeds to step 1405 which sets an initial value $B_2$ in the speed ΔRS of renewal of the skip amounts RSR and RSL. That is, the speed ΔRS is skipped by the value $B_2$. Note, the value $B_2$ is definite, but can vary in accordance with a load parameter such as the intake air amount Q and the engine speed Ne. Conversely, if the second air-fuel ratio flag F2 is not reversed, the control proceeds to step 1406 which multiplies the speed ΔRS by a predetermined ratio $k_2$ (<1) by $$\Delta RS \leftarrow \Delta RS \cdot k_1.$$

Therefore, when the routine of FIG. 14 is carried out n times after the output of the second air-fuel ratio flag F2 is reversed, $\Delta RS = B_2 \cdot k_2^n$. As a result, the speed ΔRS is remarkably increased at a switching of the output $V_2$ of the downstream-side $O_2$ sensor 15, and thereafter, the speed ΔRS is gradually decreased.

Figure 15:
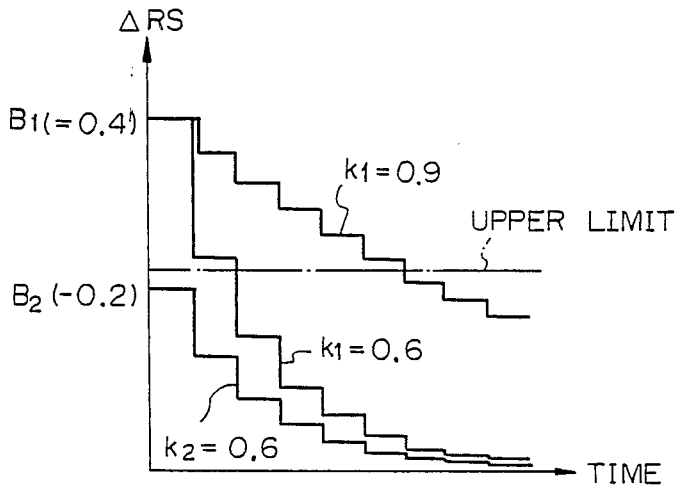
FIG. 15 is a timing diagram explaining the value ΔRS of FIG. 14.

The above-mentioned speed ΔRS of renewal of the skip amounts RSR and RSL is explained with reference to FIG. 15. For example, after the air-fuel ratio downstream of the catalyst converter 12 is switched from the rich side to the lean side, the speed ΔRS is defined by $B_1 = 0.4$ and $k_1 = 0.9$ (or $k_1 = 0.6$). Also, after the air-fuel ratio downstream of the catalyst converter 12 is switched from the lean side to the rich side, the speed ΔRS is defined by $B_2 = 0.2$ and $k_2 = 0.6$. Note that, in this case, in order to reduce the fluctuation of the air-fuel ratio, an upper limit as indicated by a solid-dotted line can be imposed on the speed ΔRS.

Figures 16A, 16B, 16C:
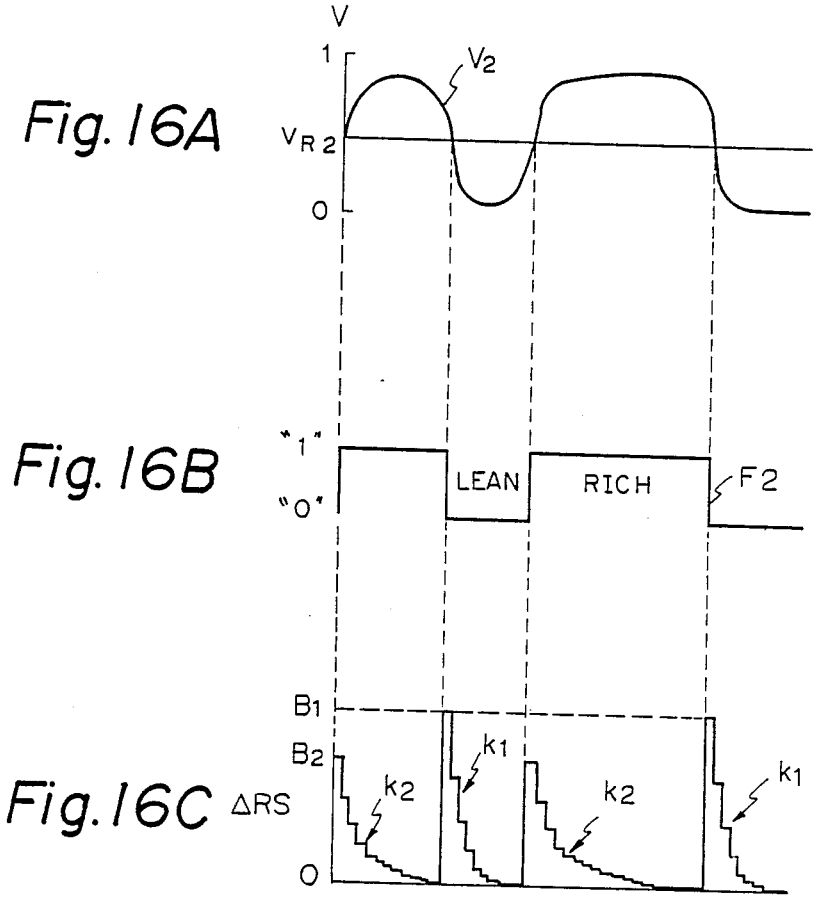
FIGS. 16A through 16F are timing diagrams explaining the flowchart of FIG. 14.
Figures 16D, 16E, 16F:
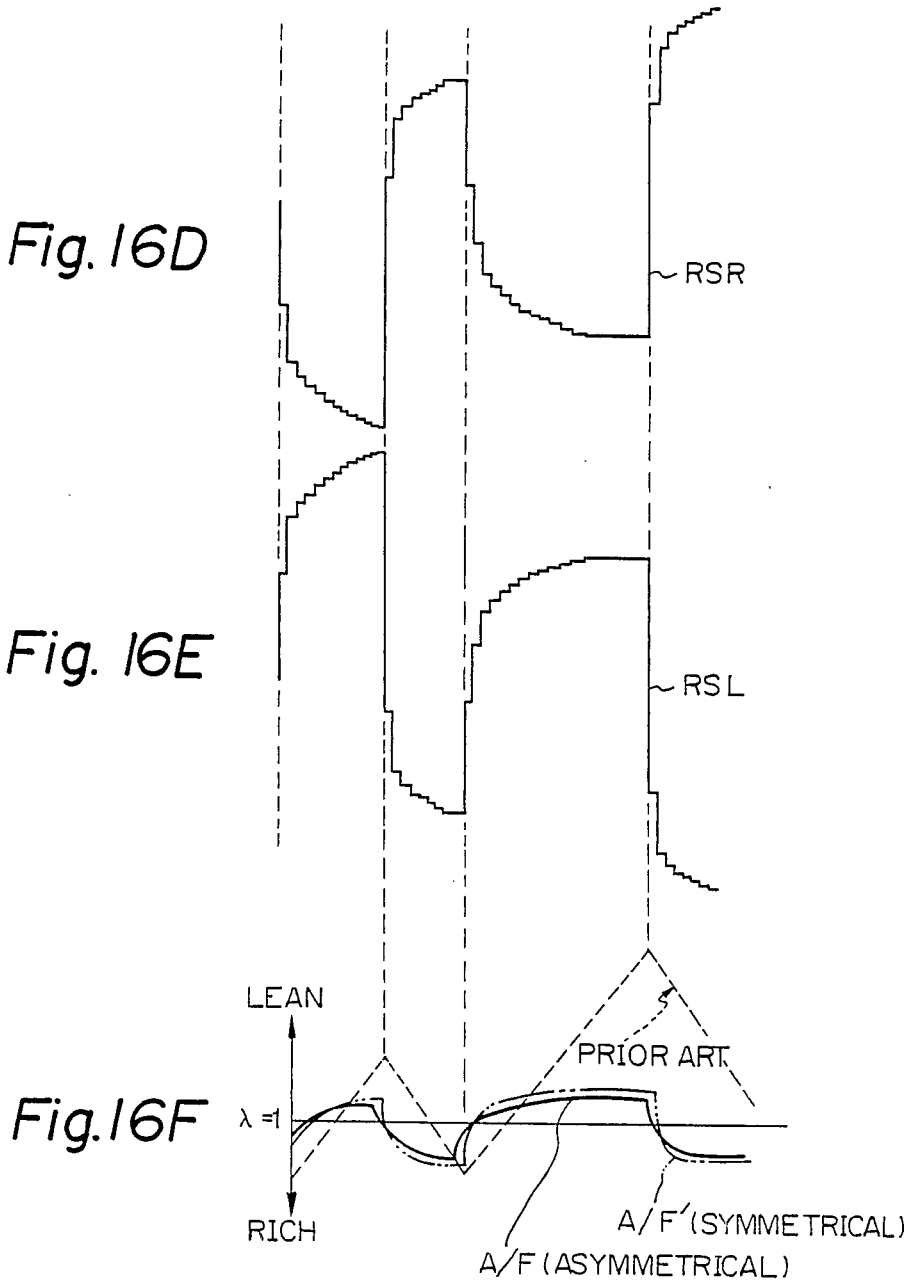

FIGS. 16A through 16F are timing diagrams explaining the routine of FIG. 14. Note, FIGS. 14A through 14F correspond to FIGS. 13E through 13I, respectively. That is, when the output $V_2$ of the downstream-side $O_2$ sensor 15 is changed as shown in FIG. 15A, and accordingly, the second air-fuel ratio flag F2 is changed as shown in FIG. 15B, the speed ΔRS where the second air-fuel ratio flag F2 is "1" is assymmetrical to the speed ΔRS where the second air-fuel ratio flag F2 is "0" as shown in FIG. 16C, since $A_1 > A_2$ and $k_1 > k_2$. The asymmetrical speed ΔRS affects the rich skip amount RSR and the lean skip amount RSL as illustrated in FIGS. 16D and 16E. Also, the rich skip amount RSR and the lean skip amount RSL affect the air-fuel ratio correction amount FAF1 calculated by the routine of FIG. 4 which are carried out at every short time period such as 4 ms. Therefore, the air-fuel ratio A/F upstream of the catalyst converter 12 is changed as indicated by the solid line in FIG. 16F. That is, the amplitude of the air-fuel ratio A/F is smaller than the air-fuel ratio A/F' where the speed ΔRS is made symmetrical by the routine of FIG. 11 where $A_1 = A_2 = A$ and $k_1 = k_2 = k$. Particularly, the deviation of the air-fuel ratio to the lean side is reduced, thereby decreasing the $NO_X$ emission.

Note that, at step 615 of FIG. 6, at steps 903 and 904 of FIG. 9, at step 1112, and at steps 1403 and 1404, it is possible to reduce the speed ΔRS by subtracting a predetermined value therefrom.

Also, the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. That is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as the integration amounts KIR and KIL, the delay time periods TDR and TDL, or the reference voltage $V_{R1}$, are variable.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 701 of FIG. 7 or at step 1201 or FIG. 12 is determined by the carburetor itself, i.e., the intake air negative pressure and the engine speed, and the air amount corresponding to TAU at step 703 of FIG. 7 or at step 1203 of FIG. 12.

Further, a CO sensor, a lean-mixture sensor or the like can be also used instead of the $O_2$ sensor.

We claim:

1. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, said method comprising the steps of:

calculating an air-fuel ratio correction amount in accordance with the outputs of said upstream-side and downstream-side air-fuel ratio sensors;

skipping a speed of changing said air-fuel ratio correction amount in accordance with the output of the downstream-side air-fuel ratio sensor by a speed skip amount immediately after the output of said downstream-side air-side ratio sensor is switched between the rich side and the lean side;

gradually decreasing the speed of changing said air-fuel ratio correction amount in accordance with the output of said downstream-side air-fuel ratio sensor ate decreasing speed after the speed of changing said air-fuel ratio correction amount is skipped; and adjusting an actual air-fuel ratio is accordance with said air-fuel ratio correction amount;

wherein said air-fuel ratio correction amount calculating step comprises the steps of:

calculating an air-fuel ratio feedback control parameter in accordance with the output of said downstream-side air-fuel ratio sensor; and calculating said air-fuel ratio correction amount in accordance with the output of said upstream-side air-fuel ratio sensor and said air-fuel ratio feedback control parameter;

said skipping step skipping a speed of changing said air-fuel ratio feedback control parameter when the output of said downstream-side air-fuel ratio sensor is switched between the rich side and the lean side;

said gradually decreasing step gradually decreasing the speed of changing said air-fuel ratio feedback control parameter when the output of said downstream-side air-fuel ratio sensor indicates a lean state or a rich state.

2. A method as set forth in claim 1, wherein the speed skip amount of said speed of changing of said air-fuel ratio correction amount in the case where the output of said downstream-side air-fuel ratio sensor is switched from the rich side to the lean side is different from the speed skip amount of said speed of changing of said air-fuel ratio correction amount in the case where the output of said downstream-side air-fuel ratio sensor is switched from the lean side to the rich side.

3. A method as set forth in claim 2, wherein the speed skip amount of said speed of changing said air-fuel ratio correction amount in the case where the output of said downstream-side air-fuel ratio sensor is switched from the rich side to the lean side is larger than the speed skip amount of said speed of changing said air-fuel ratio correction amount in the case where the output of said downstream-side air-fuel ratio sensor is switched from the lean side to the rich side.

4. A method as set forth in claim 1, wherein the decreasing speed of the speed of changing said air-fuel ratio correction amount in the case where the output of said downstream-side air-fuel ratio sensor indicates a lean state is different from the decreasing speed of the speed of changing said air-fuel correction amount in the case where the output of said downstream-side air-fuel ratio sensor indicates a rich state.

5. A method as set forth in claim 4, wherein the decreasing-speed of the speed of changing said air-fuel ratio correction amount in the case where the output of said downstream-side air-fuel ratio sensor indicates a lean state is higher than the decreasing speed of the speed of changing said air-fuel ratio correction amount in the case where the output of said downstream-side air-fuel ratio sensor indicates a rich state.

6. A method as set forth in claim 1, wherein said gradually decreasing step decreases the speed of changing said air-fuel ratio correctionamount by a predetermined ratio per unit time.

7. A method as set forth claim 1, wherein said gradually decreasing step decreases the speed of changing said air-fuel ratio correction amount by a predetermined amount per unit time.

8. A method as set forth in claim 1, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

9. A method as set forth in claim 1, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correctionamount is gradually increased when the output of said upstream-side air-fuel ratio sensor is on the lean side.

10. A method as set forth in claim 1, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

11. A method as set forth in claim 1, wherein said air-fuel ratio feedback control parameter is determined by a reference voltage with which the output of said upstream-side air-fuel ratio sensor is compared, thereby determining whether the air-fuel ratio is on rich side or on the lean side.

12. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, said apparatus comprising:

means for calculating an air-fuel ratio correction amount in accordance with the outputs of said upstream-side and downstream-side air-fuel ratio sensors;

means for skipping a speed of changing said air-fuel ratio correction amount in accordance with the output of the downsteam-side air-fuel ratio sensor by a speed skip amount immediately after the output of said downsteam-side air-fuel ratio sensor is switched between the rich side and the lean side;

means for gradually decreasing the speed of changing said air-fuel ratio correction amount in accordance with the output of said downstream-side air-fuel ratio sensor at a decreasing speed after the speed of changing said air-fuel ratio correction amount is skipped; and means for adjusting an actual air-fuel ratio in accordance with said air-fuel ratio correction amount;

wherein said air-fuel ratio correction amount calculating means comprises:

means for calculating an air-fuel ratio feedback control parameter in accordance with the output of said downstream-side air-fuel ratio sensor; and means for calculating said air-fuel ratio correction amount in accordance with the output of said upstream-side air-fuel ratio sensor and said air-fuel ratio feedback control parameter;

said skipping means skipping a speed of changing said air-fuel ratio feedback control parameter when the output of said downstream-side air-fuel ratio sensor is switched between the rich side and the lean side;

said gradually decreasing means gradually decreasing the speed of changing said air-fuel ratio feedback control parameter when the output of said downstream-side air-fuel ratio sensor indicates a lean state or a rich state.

13. An apparatus as set forth in claim 12, wherein the speed skip amount of said speed of changing said air-fuel ratio correction amount in the case where the output of said downstream-side air-fuel ratio sensor is switched from the rich side to the lean side is different from the speed skip amount of said speed of changing said air-fuel ratio correction amount in the case where the output of said downstream-side air-fuel ratio sensor is switched from the lean side to the rich side.

14. An apparatus as set forth in claim 13, wherein the speed skip amount of said speed of changing said air-fuel ratio correction amount in the case where the output of said downstream-side air-fuel ratio sensor is switched from the rich side to the lean side is larger than the speed skip amount of said speed of changing said air-fuel ratio correction amount in the case where the output of said downstream-side air-fuel ratio sensor is switched from the lean side to the rich side.

15. An apparatus as set forth in claim 12, wherein the decreasing speed of the speed of changing said air-fuel ratio correction amount in the case where the output of said downstream-side air-fuel ratio sensor indicates a lean state is different from the decreasing speed of the speed of changing said air-fuel ratio correctionamount in the case where the output of said downstream-side air-fuel ratio sensor indicates a rich state.

16. An apparatus as set forth in claim 15, wherein the decreasing speed of the speed of changing said air-fuel ratio correction amount in the case where the output of said downstream-side air-fuel ratio sensor indicates a lean state is higher than the decreasing speed of the speed of changing said air-fuel ratio coreectionamount in the case where the output of said downstream-side air-fuel ratio sensor indicates a rich state.

17. An apparatus as set forth in claim 12, wherein said gradually decreasing means decreases the speed of changing said air-fuel ratio correction amount by a predetermined ratio per unit time.

18. An apparatus as set forth in claim 12, wherein said gradually decreasing means decreases the speed of changing said air-fuel ratio correction amount by a predetermined amount per unit time.

19. An apparatus as set forth in claim 12, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

20. A method as set forth in claim 12, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio corectionamount is gradually increased when the output of said upstream-side air-fuel ratio sensor is on the lean side.

21. A method as set forth in claim 12, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

22. A method as set forth in claim 12, wherein said air-fuel ratio feedback control parameter is determined by a reference voltage with which the output of said upstream-side air-fuel ratio sensor is compared, thereby determining whether the air-fuel ratio is on the rich side or on the lean side.

* * * * *